US012145700B2

(12) United States Patent
Roche

(10) Patent No.: US 12,145,700 B2
(45) **Date of Patent: *Nov. 19, 2024**

(54) HUMAN POWERED CATAMARAN-STYLED WATERCRAFT AND METHODS

(71) Applicant: Aqua-Spider, LLC, Oconomowoc, WI (US)

(72) Inventor: Daniel P. Roche, Oconomowoc, WI (US)

(73) Assignee: Aqua-Spider, LLC, Oconomowoc, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/517,480

(22) Filed: Nov. 22, 2023

(65) Prior Publication Data

US 2024/0083549 A1 Mar. 14, 2024

Related U.S. Application Data

(63) Continuation of application No. 17/577,910, filed on Jan. 18, 2022, now Pat. No. 11,952,086, which is a (Continued)

(51) Int. Cl.
*B63B 7/04* (2020.01)
*B63B 3/08* (2006.01)
(Continued)

(52) U.S. Cl.
CPC ..... *B63B 7/04* (2013.01); *B63B 3/08* (2013.01); *B63B 29/04* (2013.01); *B63B 34/50* (2020.02);
(Continued)

(58) Field of Classification Search
None
See application file for complete search history.

(56) References Cited

U.S. PATENT DOCUMENTS 5,405 A * 12/1847 McCarthy ..... B64C 11/006 416/116
1,831,229 A 11/1931 Clark
(Continued)

FOREIGN PATENT DOCUMENTS

EP 2165928 3/2010
EP 2165928 A2 * 3/2010 ..... B63H 16/12
(Continued)

*Primary Examiner* — S. Joseph Morano
*Assistant Examiner* — Jovon E Hayes
(74) *Attorney, Agent, or Firm* — RYAN KROMHOLZ & MANION, S.C.

(57) ABSTRACT

An apparatus and methods according to the present invention provides a human powered catamaran-styled watercraft and methods of configuring and operating the watercraft. The watercraft generally comprises at least one hull in communication with a folding collapsible frame, wherein in the frame comprises a center rack pivotally joining hulls of hull sets to provide for common pivoting of the hulls during articulation of the watercraft, thereby the hulls and frame are in further communication through a at least one pivot pad which provides for slidable pivoting of the hulls during articulation of the watercraft. A method of folding and reversibly extending the watercraft to provide for optimized storage is provided. A method of operation of the watercraft to provide for articulation of the watercraft is provided.

19 Claims, 16 Drawing Sheets

Related U.S. Application Data continuation of application No. 16/929,617, filed on Jul. 15, 2020, now Pat. No. 11,230,353.

(60) Provisional application No. 62/878,647, filed on Jul. 25, 2019.

(51) Int. Cl.
*B63B 29/04* (2006.01)
*B63B 34/50* (2020.01)
*B63H 16/20* (2006.01)

(52) U.S. Cl.
CPC ..... *B63H 16/20* (2013.01); *B63B 2003/085* (2013.01); *B63B 2029/043* (2013.01); *B63B 2221/22* (2013.01); *B63H 2016/202* (2013.01)

(56) References Cited

U.S. PATENT DOCUMENTS 3,083,382 A 4/1963 Havens et al.
3,970,025 A * 7/1976 Sovia ..... B63B 1/14 114/61.19
4,323,352 A 4/1982 Warren et al.
4,698,034 A * 10/1987 Anthonijsz ..... B63B 1/121 114/352
4,968,274 A 11/1990 Gregory
5,011,441 A 4/1991 Foley et al.
D321,854 S 11/1991 Foley et al.
5,301,623 A 4/1994 McMillers
5,374,206 A * 12/1994 Gregory ..... B63B 34/50 440/27
5,405,275 A 4/1995 Schlangen et al.
5,540,604 A * 7/1996 Dayton ..... B63H 16/14 114/61.24
5,577,940 A 11/1996 Adler
5,626,501 A 5/1997 He
5,651,706 A 7/1997 Kasper
5,879,208 A 3/1999 Adler
6,065,414 A 5/2000 Hulbig et al.
6,083,062 A * 7/2000 Treloar ..... B63H 16/12 440/90
6,691,633 B1 * 2/2004 Metzger ..... B63H 16/12 440/26
6,855,016 B1 * 2/2005 Jansen ..... B63H 21/17 440/27
6,874,439 B2 4/2005 Conti
7,021,978 B2 4/2006 Janser
7,037,149 B1 5/2006 Mauzy
7,371,138 B2 5/2008 Spass
8,640,640 B2 2/2014 Conti et al.
8,986,057 B2 * 3/2015 Catarina ..... A63B 22/04 440/21
9,174,714 B2 * 11/2015 Kachkovsky ..... B63B 1/12
9,463,857 B1 10/2016 Schiller et al.
9,650,109 B2 5/2017 Schiller et al.
10,046,841 B2 8/2018 Schiller et al.
2014/0370767 A1 * 12/2014 Kachkovsky ..... B63H 16/14 440/27
2021/0024174 A1 * 1/2021 Roche ..... B63B 7/085

FOREIGN PATENT DOCUMENTS

KR 200401246 Y 11/2005
KR 1020130050210 5/2013

* cited by examiner

HUMAN POWERED CATAMARAN-STYLED WATERCRAFT AND METHODS

RELATED APPLICATIONS

This application is a continuation of patent application Ser. No. 17/577,910, filed 18 Jan. 2022, which is a continuation of U.S. Pat. No. 11,230,353, issued 25 Jan. 2022, which claims the benefit of provisional application Ser. No. 62/878,647 filed 25 Jul. 2019.

BACKGROUND OF THE INVENTION

The present invention is directed to watercraft. More specifically, the present invention is directed to a human powered catamaran-styled watercraft. More specifically, the present invention is directed to human powered catamaran-styled watercraft having articulated steering and folding collapsible frames.

Multi-hulled vessels, such as catamarans, have existed in the art. Catamarans have significant advantage over mono-hulled vessels, specifically in stability. However, catamarans of the prior art have major a disadvantage, specifically the combination of agility comparable to a mono-hulled vessel and the ability to maximize storage space available is not provided in the prior art. Multi-hulls, including catamarans, of the prior art typically lack the ability to turn upon an axis and instead force the outside hull to be dragged in the water on a longer radius. The prior art has provided for catamarans which have articulated hulls to address the issue of agility. However, agility has not been maximized due to the prior art designs lacking a slidable pivot relationship between the hulls and the frame of the particular prior art vessel. The relationships between the hulls and the frames of prior art catamarans are unable to maximize agility characteristics.

Further, in the quest to attain agile characteristics the catamarans of the prior art retain a significant foot print with respect storage. The prior art provides for articulated catamarans, but the catamarans of the prior art lack the structure to provide for folding of the entire catamaran to achieve a small storage foot print. Though the prior art does provide for folding of the hulls in certain scenarios, the prior art catamarans simply do not account for a complete folding configuration of the prior art catamaran frames to provide for optimized storage. Further, the prior art does not provide for a drive assembly in a human powered catamaran which is able to be folded for ease of storage.

A need exists for a watercraft having articulated motion and a folding collapsible frame to provide for storage and transportation.

A need exists for a watercraft providing for a slidable relation between the frame and the hull to provide for maximized articulation.

A need exists for a watercraft providing for a drive assembly able to be folded with ease for storage and operation.

SUMMARY OF THE INVENTION

The present invention is directed to a human powered catamaran-styled watercraft. The watercraft comprises a folding collapsible frame in communication with at least one, preferably four, hulls. The folding collapsible frame is centrally positioned between the hulls. The remainder of the description of the watercraft will reference the watercraft as comprising four hulls. However, it is observed the watercraft may have more than four hulls and the watercraft may have less than four hulls.

Each hull comprises a hull first end and an oppositely opposed hull second end. Two hulls are positioned in close proximity to a watercraft first end. Where the watercraft first end maybe be a forward position. Two hulls are positioned in close proximity to a watercraft second end. Where the watercraft second end may be a rear position. One of the two hulls in close proximity to the watercraft first end is positioned on a first side of the watercraft and is a front hull. One of the two hulls in close proximity to the watercraft second end is positioned on the first side of the watercraft and is a rear hull. The front hull and rear hull are positioned such that the hull second end of the front hull is in close proximity to the hull first end of the rear hull, and the hull second end of the front hull and the hull first end of the rear hull are in close proximity to a watercraft length center of the watercraft length. The hull second end of the front hull and the hull first end of the rear hull are in removable communication at a hull pivot joint. The hull pivot joint provides for articulation of the respective hulls and folding of the respective hulls into a folded configuration.

A first hull set is positioned on the first side of the watercraft, and second hull set on a second side of the watercraft. A hull set comprises at least two hulls. The first set and the second hull set are removably joined by a center rack positioned in close proximity to the watercraft length center, which additionally provides for support to the watercraft from vertical forces. The folding collapsible frame comprises at least one of a central frame assembly, at least one first arm, at least one second arm, and the center rack. The central frame assembly comprises at least of a forward frame, central frame, lower drive shaft assembly in communication with one another. The forward frame comprises a pedal assembly in communication with an upper drive shaft assembly. The pedal assembly is in close proximity to the forward position. The upper drive shaft assembly is in removable communication with the lower drive shaft assembly, to provide for configuring the watercraft into the folded configuration. Specifically, an upper drive shaft assembly of the forward frame of the folding collapsible frame is in pivotal communication with a central frame of the folding collapsible frame at a central frame first location. The lower drive assembly ends at least in close proximity to a propeller, wherein the propeller is in close proximity to the rear position. The folding collapsible frame provides for a removable seat positioned on the central frame of the folding collapsible frame so an operator may be seated on the watercraft. The folding collapsible frame further comprising at least one retractable wheel positioned in close proximity to the rear position.

The watercraft may be configured in an extended operational configuration and the folded configuration. The folded configuration may provide for storage of the watercraft in multiple orientations, including a horizontal and a vertical orientation, allowing for a reduced storage footprint. The folded configuration of the watercraft comprises the front hull of at least one of the first hull set and the second hull set removably resting on the watercraft first side of the rear hull of at least one of the first hull set and the second hull set. A front hull pivot joint component, part of the hull pivot joint, is in communication with the hull second end of the front hull. A rear hull pivot joint component, part of the hull pivot joint, is in communication with the hull first end of the rear hull. When the front hull is removably resting on the watercraft first side of the rear hull of at least one of the first hull set and the second hull set, the front hull pivot joint component and the rear hull pivot joint component of the respective hull set are separated by a locking configuration distance. A first locking pin provides for locking of the watercraft in a folded configuration, and a second locking pin provides for locking of the watercraft in the extended operational configuration. An intended benefit of the invention is to provide for a watercraft having articulated motion and a folding collapsible frame to provide for storage and transportation. The folded configuration provides for a storage of the watercraft in confined spaces. Further, the folded configuration provides for transporting the watercraft in confined spaces or without requiring a transport platform, not illustrated in the figures, which is substantially equal to the watercraft length.

At least one first arm extends from a central frame location. At least one second arm in extended communication from a second central frame location. There are preferably two second arms.

The center rack is positioned through a central frame cavity such that the center rack is at least substantially perpendicular to the longitudinal axis of the watercraft.

The pivotal communication of the retractable wheel is provided by at least one wheel bracket. Wherein the wheel bracket provides for the retractable wheel in the wheel first position when the folding collapsible frame, watercraft, is in the extended operational configuration. Wherein the wheel bracket provides for the retractable wheel in the wheel second position when the folding collapsible frame, watercraft, is in the folded configuration. While in the folded position, the retractable wheels may provide for ease of transportation of the watercraft in the folded configuration using various modes of ground transportation. A steering assembly is positioned within the central frame cavity of the central frame, wherein the steering mechanism communicates with the center rack to provide for articulation of the watercraft.

The hull pivot joint is removably attached to the center rack first end. A second hull pivot joint is removably attached to the center rack second end. An axle extends from at least one of the center rack first end and the center rack second end along a center rack longitudinal axis. The axle providing for rotational attachment of components of the hull pivot joint to the center rack, wherein the watercraft may be configured in the extended operational configuration and adjusted to the folded configuration, and the reverse. Additionally, a method of transforming the watercraft from the extended operational configuration to the folded configuration is illustrated.

A pivot pad is positioned on the watercraft first side of at least one of the front hulls and the rear hulls. The pivot pad is in slidable communication with a pivot arm, extending from the pivot pad and in the direction of at least one of a first arm pad end and a second arm pad end. The respective pivot arm and the respective at least one of the first arm pad end and the second arm pad end, in close proximity to the respective pivot arm, are in slidable communication and provide for articulation of the respective hull.

An arm first end is slidably positioned within the pad cavity. A cradle extension of the pivot pad exerts a force on a through hole wall of a first end through hole of the arm first end at a location of the through hole wall promoting articulation of the hull. As such at least one first end surface of the first end provides for contact with a pivot pad cradle cavity dimension which promotes an articulated position of the hull. Thus, the slidable relationship between the pivot arm and pivot pad provides for maneuverability of the hull into an articulated position. Alternatively, the above relationship between the pivot arm and the pivot pad provides for a non-articulated position of the watercraft as well. An intended benefit of the invention is to provide for a slidable relation between the folding collapsible frame and the hull to provide for maximized articulation while maintaining close proximity between the hull second end of the front position hull and the hull first end of the rear position hull of each set. This benefit ensures articulation without introducing space between the hull ends and the resultant turbulence between hull components.

A drive assembly of the watercraft extends from the pedal assembly, through a forward frame and to a central frame, through the central frame and to the lower drive assembly, and through the lower drive shaft assembly to the propeller. The drive comprises a fly wheel which captures and applies momentum in the drive assembly. An upper drive shaft second end is in at least one of removable and rotational communication with a fly wheel. The removable communication of the upper drive shaft second end with the fly wheel provides for the rotational pivoting of a forward frame when the watercraft is placed in the folded configuration. Wherein the drive assembly provides propulsion to advance the watercraft through operator manipulation of the pedals of the pedal assembly. It is observed, the watercraft may provide for mechanized modes of propulsion for example: gearing systems and motorized systems. An intended benefit of the present invention is to provide for a watercraft having a drive assembly able to be folded with ease for folding, storage and operation.

The hull may be in an inflated hull position. The hull may be arranged into deflated hull position for storage and the hull may be a drop stitch hull to promote a flat surface upon which the pivot pad may be positioned.

A method for operation of the watercraft is provided. Positioning the handle bar in a forward position such that the hull length of each of the respective hulls of the first hull set and second hull set are at least substantially parallel to the longitudinal axis. Traveling in a non-articulated direction. Additionally, advancing the handle bar in at least one of a clockwise rotation and a clock-wise rotation, with respect to an operator positioned facing the pedal assembly. Further, the method provides for advancing the center rack in at least one of a first side direct and a second side direction. Wherein the hulls of the first hull set are joined at the hull pivot joint in communication with the center rack first end, and the hulls of the second hull set are joined at the hull pivot joint in communication with the center rack second end, such that the hulls of the first set and the hulls of the second set commonly pivot towards at least of the first side and the second side. The watercraft turns towards at least one of the first side and the second side.

As described the invention is to a human-powered watercraft comprising: a first hull section and an oppositely opposed second hull section is extending along a watercraft length, wherein the watercraft in an extended position; each of said first hull section and said second hull section comprising a first hull in pivotable and removable communication with a second hull; a frame pivotally connected to the first hull section and the second hull section; the frame housing a rack positioned substantially orthogonal to the watercraft length; the rack is positioned between the first hull section and the second hull section; and at least one of the first hull section and the second hull section has the first hull rotatable about the rack providing for a watercraft folded position.

The human-powered watercraft further comprises: the first hull and the second hull are in pivotal communication at a pivot joint; the rack has at least one extension, wherein the pivot joint maybe positioned to provide for a transition between the extended position and the folded position; at least one of an insert and a skirt in communication with the first hull and the second hull, providing for an improved fluid dynamics performance; the frame is collapsible about the rack.

The human-powered watercraft further comprises: the frame has a removable seat, wherein the seat has at least two positions along the watercraft length; the pivot joint has a first hull component affixed to the first hull and a second hull component affixed to the second hull; the first hull component and said second hull component are in removable interwoven communication in the extended position; the first hull component and the second hull component are separated by a distance in the folded position; a pin in removable communication with the pivot joint for maintaining at least one of the extended position and the folded position; at least one retractable wheel, pivotally connected to the watercraft, having a first position when the watercraft is in the folded position allowing for a movement of the watercraft on at least one of a ground and a surface.

The human-powered watercraft further comprises: the frame has at least one first arm extended towards the first hull and at least one second arm extended towards the second hull; the rack is positioned thru an opening of the at least one first arm, wherein the first arm is rotatable about the rack; in said folded position the first hull and the second hull are positioned substantially orthogonal to at least one of a ground and a surface; at least one pivot pad in pivotal connection between the frame and at least one of the first hull and the second hull, wherein the pivot pad provides for articulation of the first hull and the second hull about the longitudinal axis; at least one of the first hull and the second hull comprise a drop stitch hull; and a steering assembly in communication with the center rack, wherein the steering assembly advances the rack perpendicular to the watercraft length.

A method of storing a human-powered watercraft comprising: a first hull section and an oppositely opposed second hull section extending along a watercraft length where the watercraft is in an extended position; each of the first hull section and the second hull section comprising a first hull and a second hull; a frame housing a rack, where the rack is positioned substantially orthogonal to the watercraft length and in communication the first hull section and the second hull section at a pivot joint; removing a pin from the pivot joint; sliding the pivot joint away from the rack; rotating the first hull about the rack; and positioning the first hull proximate to the second hull; and orienting the watercraft, wherein the first hull and said second hull are substantially orthogonal to at least one of a ground and a surface.

A method of operating a human-powered watercraft comprising: a first hull section and an oppositely opposed second hull section extending substantially parallel to a longitudinal axis; each of the first hull section and the second hull section comprising a first hull and a second hull; a frame housing a rack, where the rack is positioned substantially orthogonal to the longitudinal axis and in communication with the first hull section and the second hull section; a steering assembly in communication with the rack; positioning the steering assembly in a first direction; advancing the rack in a first direction; pivoting the first hull and the second hull in a first direction at the rack; positioning the steering assembly in a second direction; advancing the rack in a second direction; and pivoting the first hull and the second hull in a second direction at the rack.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is disclosed in the specification.

Figure 1A:
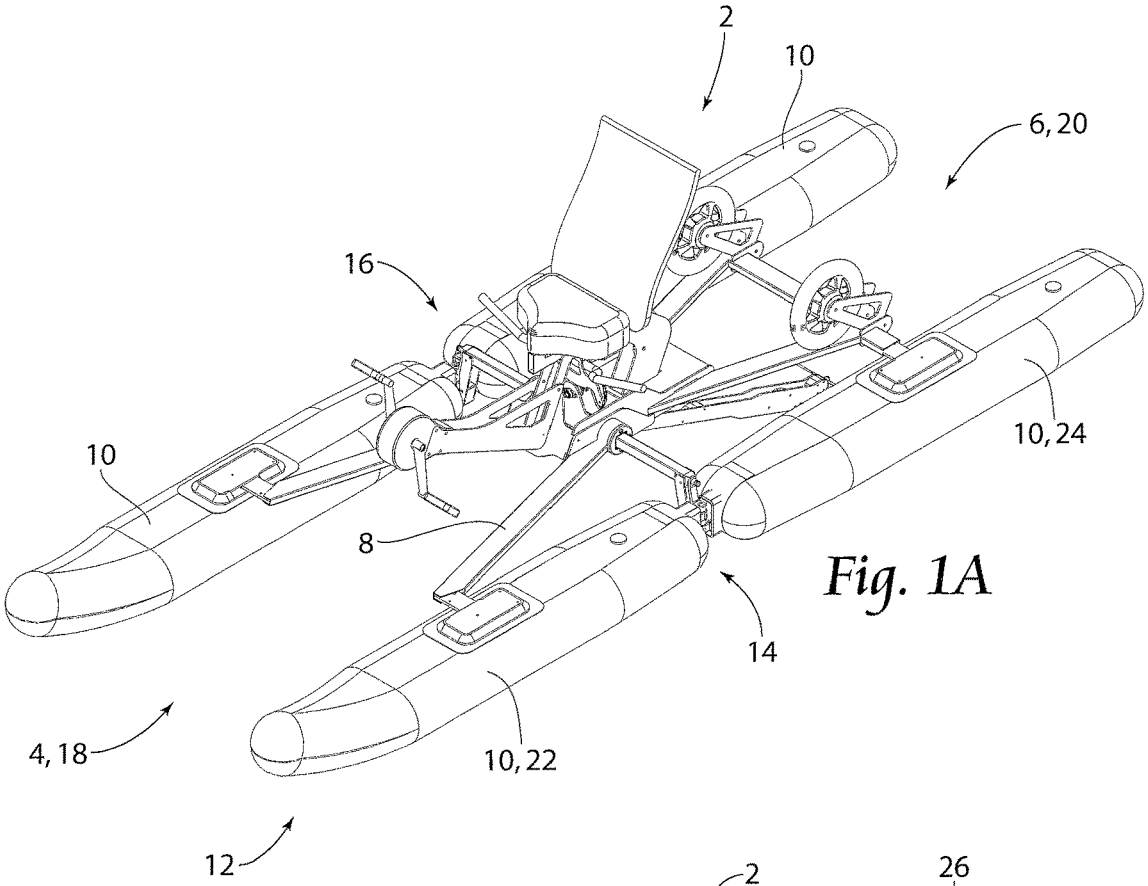
FIG. 1A is a perspective top plane view of the invention.
Figure 1B:
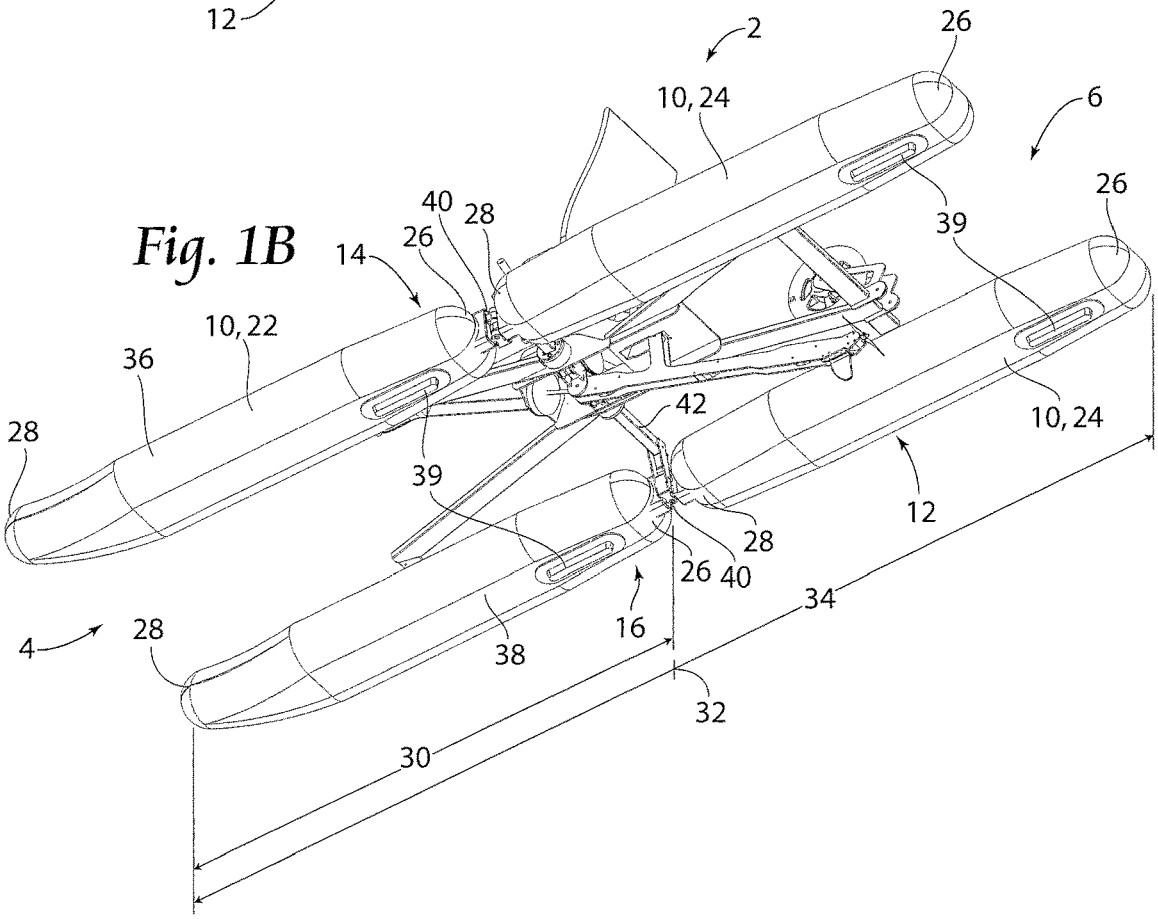
FIG. 1B is a perspective bottom plan view of the invention.

The invention is directed to a human powered catamaran-styled watercraft 2. With attention to FIGS. 1A, 1B, and 2, the watercraft 2 is illustrated in an extended operational configuration 12. The watercraft 2 comprises a folding collapsible frame 8 in communication with at least one, preferably four, hulls 10. The folding collapsible frame is centrally positioned between the hulls 10. The remainder of the description of the watercraft 2 will reference the watercraft 2 as comprising four hulls 10. However, it is observed the watercraft 2 may have more than four hulls 10 and the watercraft 2 may have less than four hulls 10. Each hull comprises a hull first end 28 and an oppositely opposed hull second end 26. The hull first end 28 and the hull second end 26 define a hull length 30. Two hulls 10 are positioned in close proximity to a watercraft first end 4. Where the watercraft first end 4 maybe be a forward position 18. Two hulls are positioned in close proximity to a watercraft second end 6. Where the watercraft second end 6 maybe be a rear position 20. One of the two hulls 10 in close proximity to the watercraft first end 4 is positioned on a first side 14 of the watercraft 2 and is a front hull 22. One of the two hulls 10 in close proximity to the watercraft second end 6 is positioned on the first side 14 of the watercraft 2 and is a rear hull 24. The front hull 22 and rear hull 24 are positioned such that the hull second end 26 of the front hull 22 is in close proximity to the hull first end of the rear hull 24, and the hull second end 26 of the front hull 22 and the hull first end 28 of the rear hull 24 are in close proximity to a watercraft length center 32 of the watercraft length 34. The hull second end 26 of the front hull 22 and the hull first end 28 of the rear hull 24 are in removable communication at a hull pivot joint 40. The hull pivot joint 40 provides for articulation of the respective hulls (10, 22, 24). The watercraft length 34 is defined between the hull first end 28 of the front hull 22 and the hull second end 26 of the rear hull 24. The watercraft 2 comprises two sets of front hulls 22 and rear hulls 24 as defined above, a first hull set 36 positioned on the first side 14 of the watercraft 2, and second hull set 38 on a second side 16 of the watercraft 2 such the first hull set 36 and the second hull set 38 are substantially parallel. A hull set (36, 38) comprises at least two hulls (10, 22, 24). The first set 36 and the second hull set 38 are removably joined by a center rack 42 positioned in close proximity to the watercraft length center 32. Each hull comprises a hull fin 39 in close proximity to the hull second end 26. It is observed the hull first end 28 of at least one of the front hulls 22 may have an elongated dimension to provide for improved hydro-dynamics.

Figure 2:
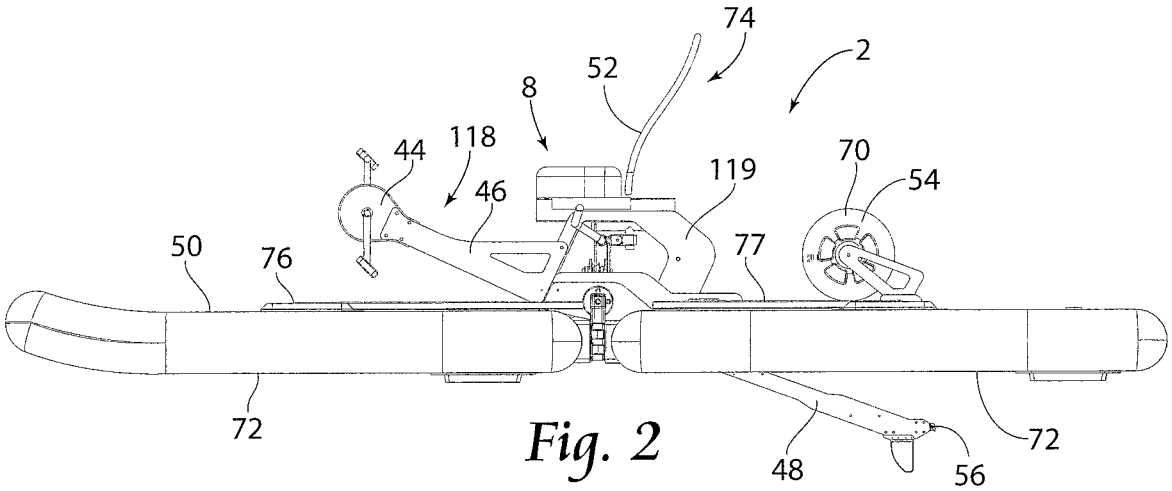
FIG. 2 is a side view of the invention.

As illustrated in FIG. 2, the folding collapsible frame 8 comprises at least one of a central frame assembly 74, at least one first arm 76, and at least one second arm 77 and a center rack 42 in communication with one another. The central frame assembly 74 comprises at least of a forward frame 118, central frame 119, lower drive shaft assembly 48 in communication with one another. The forward frame 118 comprises a pedal assembly 44 in communication with an upper drive shaft assembly 46. The pedal assembly 44 is in close proximity to the forward position 18. The upper drive shaft assembly, further illustrated in FIGS. 5, 6A, 6B and 16B, is in removable communication with the lower drive shaft assembly 48. The lower drive assembly 48 ends at least in close proximity to a propeller 56, wherein the propeller is in close proximity to the rear position 20. The folding collapsible frame 8 provides for a removable seat 52 positioned on the central frame 119 of the folding collapsible frame so an operator, not seen in the figures, may be seated on a watercraft first side 50 of the watercraft 2. The folding collapsible frame further comprising at least one retractable wheel 54 positioned in close proximity to the rear position 20.

Figure 3:
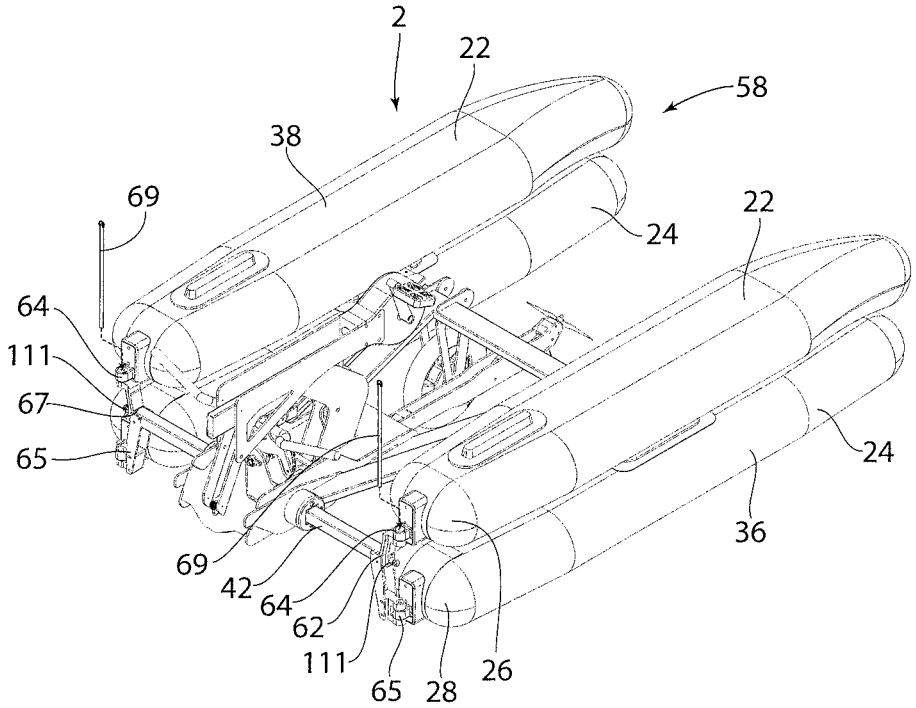
FIG. 3 is a perspective of the invention illustrating the invention in a folded position.
Figure 4:
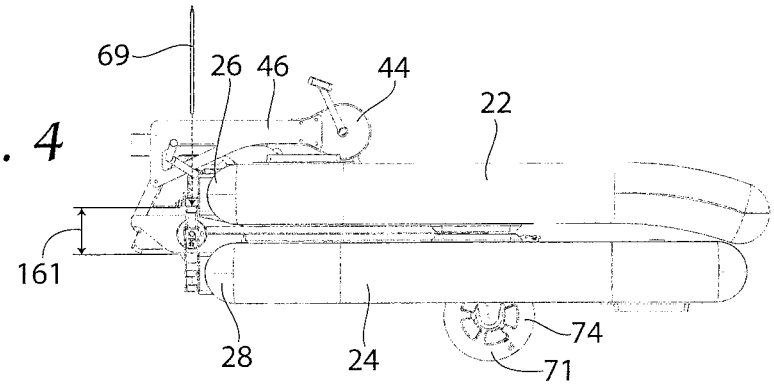
FIG. 4 is a side view of the invention illustrating folding of the invention.
Figure 9:
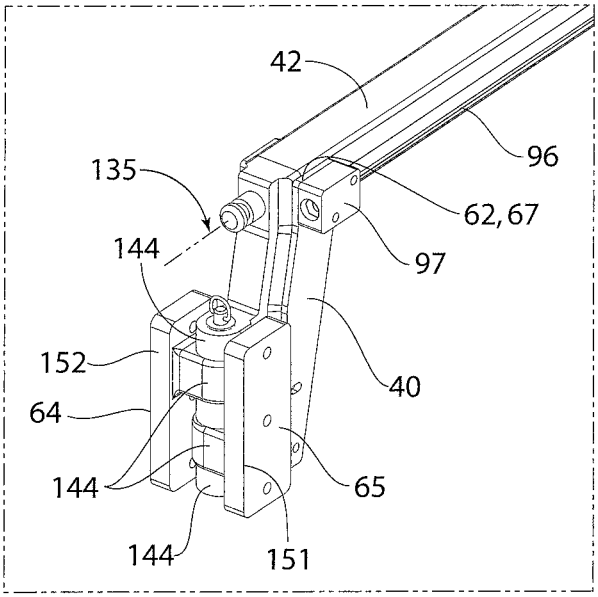
FIG. 9 is a perspective view of the at least one hull pivot joint.
Figure 10:
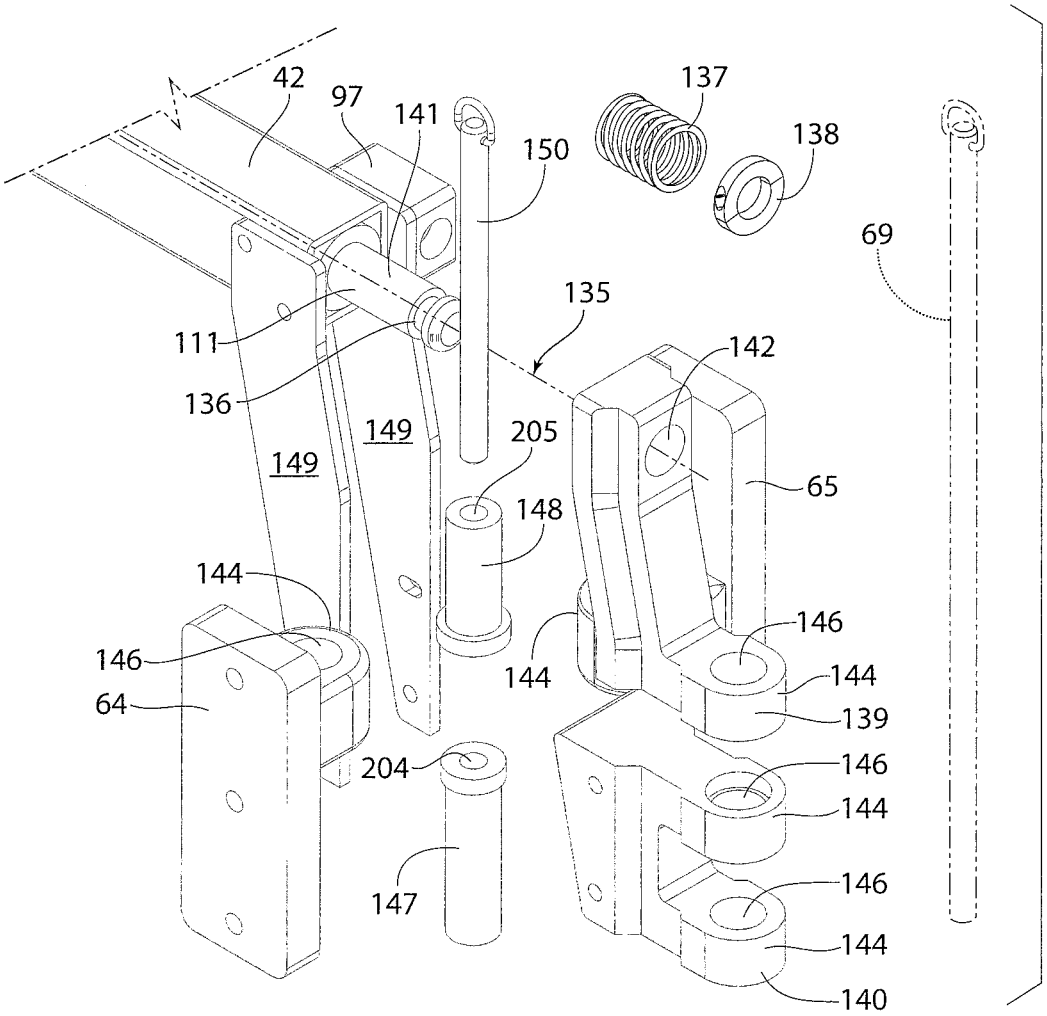
FIG. 10 is an exploded view of the at least one hull pivot joint.

As illustrated in FIGS. 3 and 4, the watercraft 2 is illustrated in a folded configuration 58. The folded configuration 58 comprises the front hull 22 of at least one of the first hull set 36 and the second hull set 38 removably resting on the watercraft first side 50 of the rear hull 24 of at least one of the first hull set 36 and the second hull set 38. A front hull pivot joint component 64, part of the hull pivot joint 40, is in communication with the hull second end 26 of the front hull 22. A rear hull pivot joint component 65, part of the hull pivot joint 40, is in communication with the hull first end 28 of the rear hull 24. Wherein a layering of the front hull pivot joint component 64, the rear hull pivot joint component 65, and other components to be described in FIGS. 9 and 10, provides for the hull pivot joint 40. When the front hull 22 is removably resting on the watercraft first side 50 of the rear hull 24 of at least one of the first hull set 36 and the second hull set 38, the front hull pivot joint component 64 and the rear hull pivot joint component 65 of the respective hull set (36, 38) are separated by a locking configuration distance 161. A first locking pin 69 is in removable and slidable communication with the front hull pivot joint component 64 and the rear hull pivot joint component 65 of the respective hull set (36, 38). The first locking pin 69 provides for locking of the watercraft 2 in a folded configuration 58. An intended benefit of the invention is to provide for a watercraft having articulated motion and a folding collapsible frame to provide for storage and transportation. The folded configuration 58 provides for a storage of the watercraft 2 in confined spaces. Further, the folded configuration 58 provides for transporting the watercraft 2 in confined spaces or without requiring a transport platform, not illustrated in the figures, which is substantially equal to the watercraft length 34.

As illustrated in FIG. 2, it is observed the retractable wheel 54 is in a wheel first position 70 when the watercraft 2 is in an extended operational configuration 12. Wherein the wheel first position 70 provides for the retractable wheel 54 in proximity to the watercraft first side 50 such that the retractable wheel 54 is positioned away from a liquid medium (not illustrated in the figures) in contact with a watercraft second side 72. As illustrated in FIG. 4, it is observed the retractable wheel 54 is in a wheel second position 71 when the watercraft 2 is in a folded configuration 58. Wherein the wheel second position 71 provides for the retractable wheel 54 in proximity to the watercraft second side 72 such that the retractable wheel 54 may provide for ease of transport of the watercraft 2 on a solid surface (not illustrated in the figures) while in the folded configuration 58.

Figure 5:
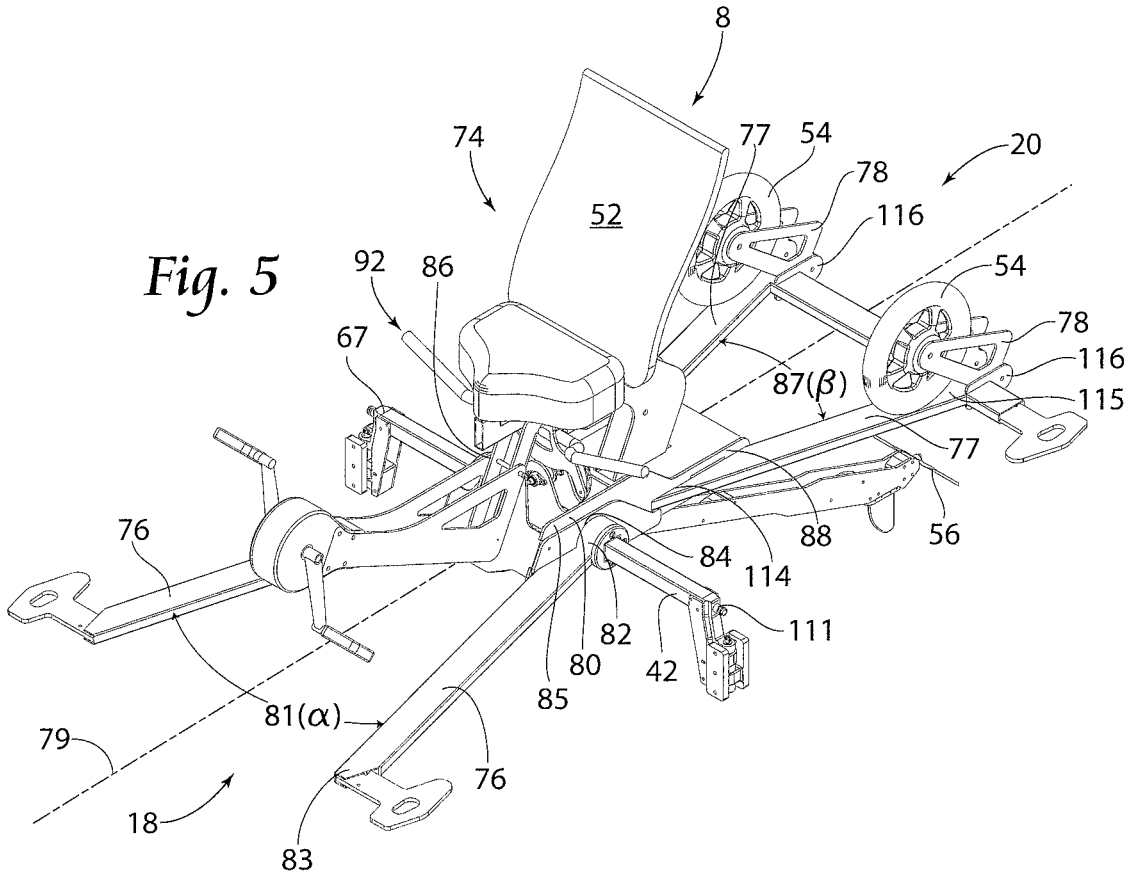
FIG. 5 is a perspective top plan view of a frame of the invention.
Figure 6A:
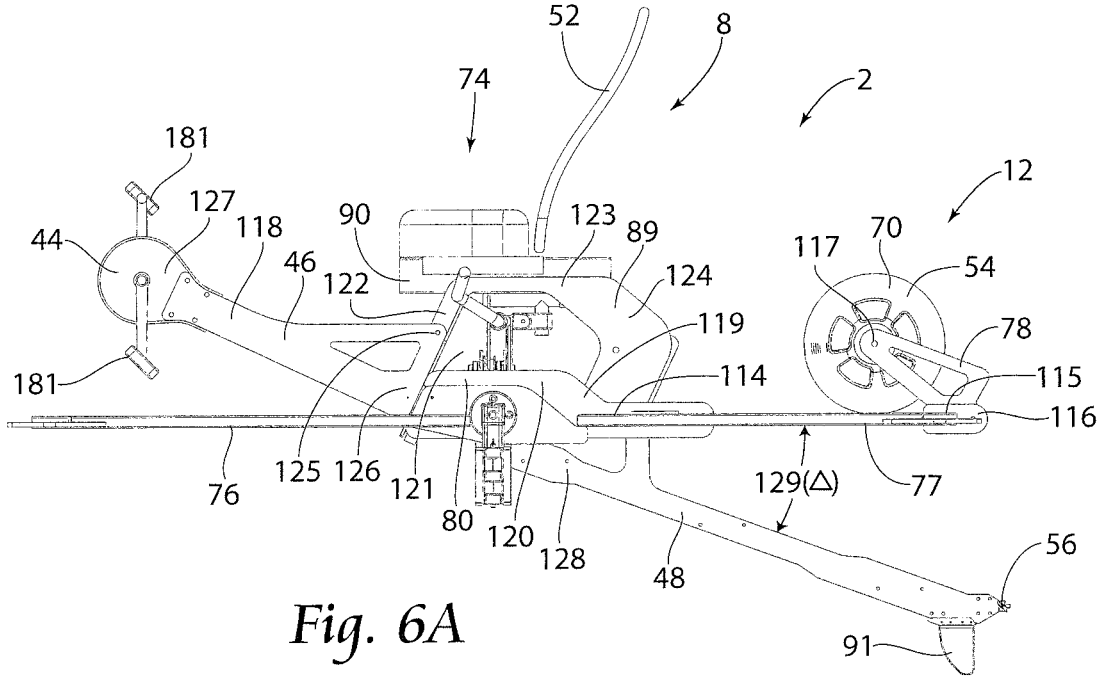
FIG. 6A is a side view of the frame of the invention.
Figure 6B:
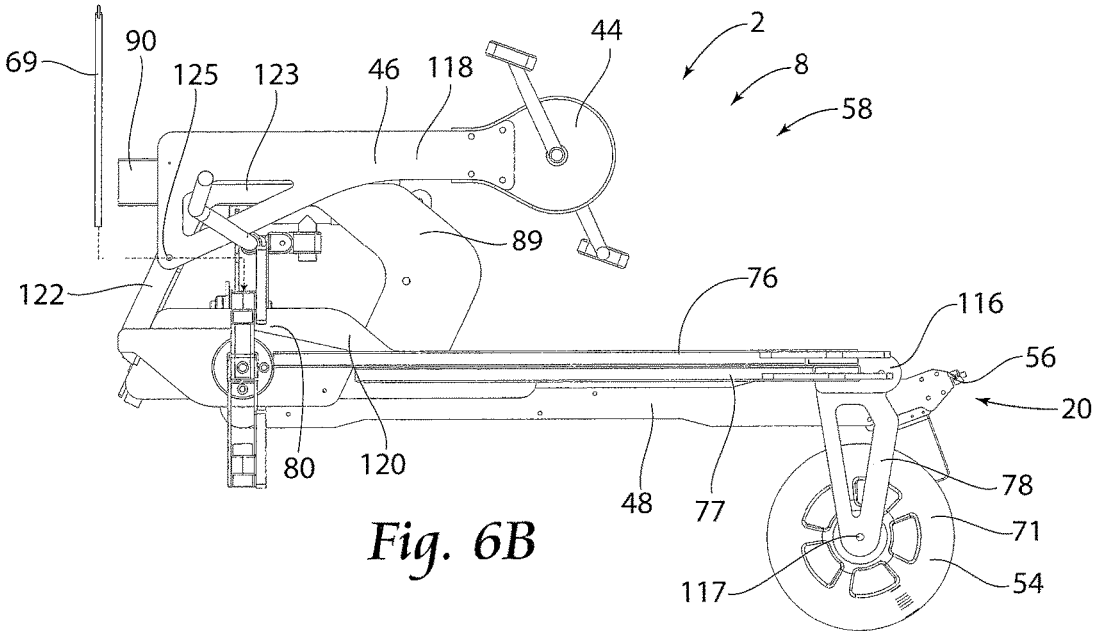
FIG. 6B is a side view of the frame of the invention illustrating folding of the frame.

With attention to FIGS. 5, 6A and 6B, the folding collapsible frame 8 is further illustrated. As further illustrated in FIG. 5, the folding collapsible frame 8 comprises at least one of a central frame assembly 74, at least one first arm 76, at least one second arm 77, and the center rack 42. As further illustrated in FIGS. 5, 6A and 6*b*, the central frame assembly 74 comprises at least one of the forward frame 118, the central frame 119, and the lower drive shaft assembly 48. The central frame 119 comprises a central frame seat section 89 and central frame base 120 in communication, wherein the relationship of the central frame seat section 89 and the central frame base 120 provides for a central frame cavity 121. The central frame seat section 89 comprises a frame section first side 122, a seat side 123, and a mounting section 124, opposite the frame section first side 122, in fixed communication.

As illustrated in FIGS. 6A and 6B, the forward frame 118 comprises a forward frame first end 127 which provides for the pedal assembly 44 and an oppositely opposed forward frame second end 126. The forward frame second end 126 is in pivotal communication with frame section first side 122 at a first side pivot location 125. A lower drive shaft assembly first side 128 is in communication with the central frame 119 to provide for a third angle (A) 129 between the lower drive shaft assembly 48 and the second arm 77 when the retractable frame 8 is in the extended operational configuration 12. As illustrated in FIG. 6B, the forward frame 118 is pivotally positioned over the set section 123 such that the pedal assembly is in close proximity to the rear position 20 when the retractable frame is in the folded configuration 58. Additionally, the third angle (A) 129 when the retractable frame 8 is in the folded configuration 58 is less than the third angle (A) 129 when the retractable frame 8 is in the extended operational configuration 12, such that the lower drive shaft assembly 48 is in close proximity to the second arm 77. A seat bar 90 resides on the seat section 123, wherein the seat 52 is in removable and adjustable communication with the seat bar 90 such that the seat 52 may be removed when the retractable frame 8 is in a folded configuration 58. It is observed the seat 52 is adjustable to accommodate fora variation in height of one operator to a second operator.

The upper drive shaft assembly 118 is in pivotal communication with the central frame 119 at a central frame first location 120. The central frame assembly 74 is positioned along a longitudinal axis 79 such that the longitudinal axis 79 extends from the forward position 18 to the rear position 20 such that the upper drive shaft assembly 46 extends substantially along the longitudinal axis and the seat 52 is substantially bisected by the longitudinal axis 79.

At least one first arm 76 extends from a central frame location 80. There are preferably two first arms 76. Wherein each first arm 76 extends from the central frame location 80 such that the longitudinal axis 79 at least substantially bisects a first arm angle (a) 81. The first arm 76 having a first arm central frame end 82 which is at least one of in rotational communication with the center rack 42 and in close proximity to the central frame assembly 74. The first arm 76 having a first arm pad end 83 oppositely opposed to the first arm central frame end 82 and providing for first arm angle (a) 81 due to its orientation with respect to the longitudinal axis 79.

The center rack 42 positioned through a central frame cavity 84 such that the center rack 42 is at least substantially perpendicular to the longitudinal axis 79. Wherein the center rack first end 62 is extended beyond a central frame first side 85. Wherein the center rack second end 67 is extended beyond a central frame second side 86.

At least one second arm 77 in extended communication from a second central frame location 88 wherein the second central seat location 88 is preferably located between the seat 52 and the rear position 20. There are preferably two second arms 77. Wherein each second arm 77 extends from the second central frame location 88 such that the longitudinal axis 79 at least substantially bisects a second arm angle (β) 87. The second arm 77 having a second arm central frame end 114 which is in fixed communication with the central frame assembly 74. The first arm 76 having a second arm pad end 115 oppositely opposed to the second arm central frame end 114 and providing for second arm angle (β) 87 due to its orientation with respect to the longitudinal axis 79. The second arm pad end 115 defining the rear position 20.

As illustrated in FIGS. 5, 6A and 6B, the wheel 54 is pivotally attached at least one of at the second arm pad end 115 and in close proximity to the second arm pad end 115. The pivotal communication is provided by at least one wheel bracket 78. Wherein the wheel bracket 78 is pivotally attached at least one of at the second arm pad end 115 and in close proximity to the second arm pad end 115, at a first bracket location 116. The wheel bracket 78 provides for rotational communication with the wheel 54 at a second bracket location 117. Wherein the wheel bracket 78 provides for the retractable wheel 54 in the wheel first position 70 when the folding collapsible frame 8, watercraft 2, is in the extended operational configuration 12. Wherein the wheel bracket 78 provides for the retractable wheel 54 in the wheel second position 71 when the folding collapsible frame 8, watercraft 2, is in the folded configuration 58.

Figure 7A:
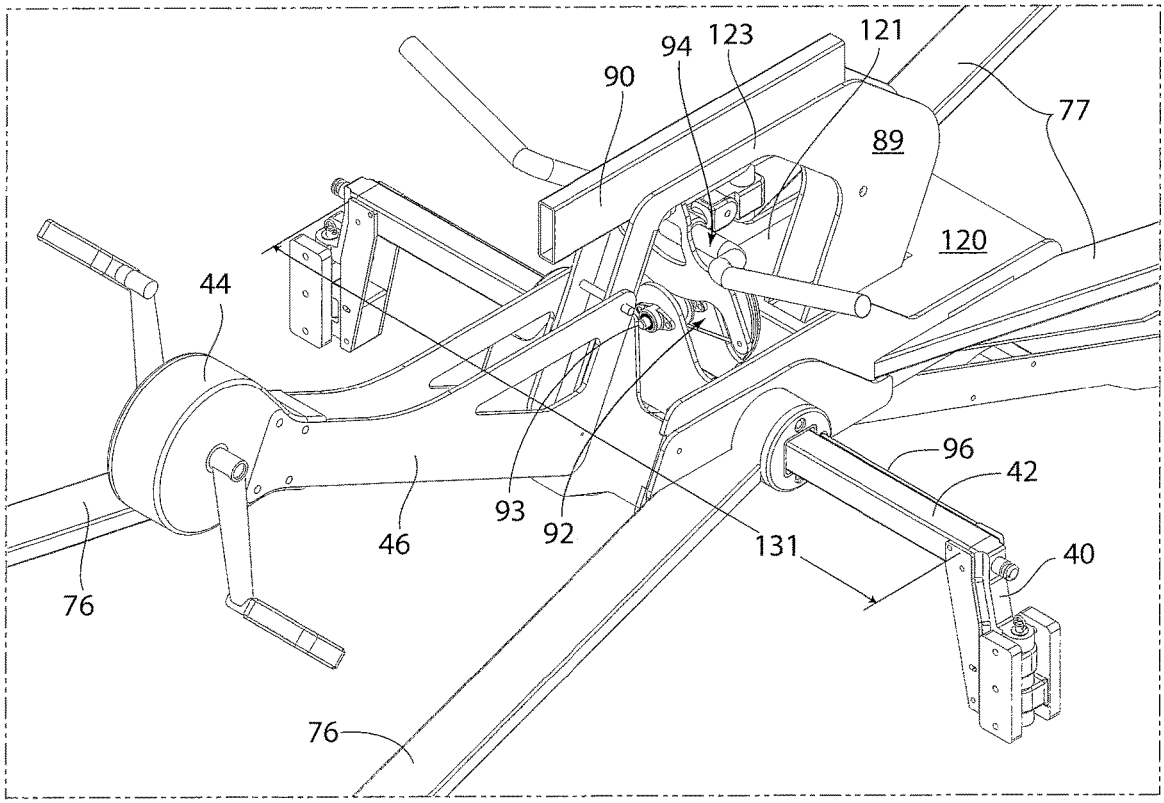
FIG. 7A is a perspective view of the frame of the invention illustrating an interrelationship between the frame and a steering assembly.
Figure 7B:
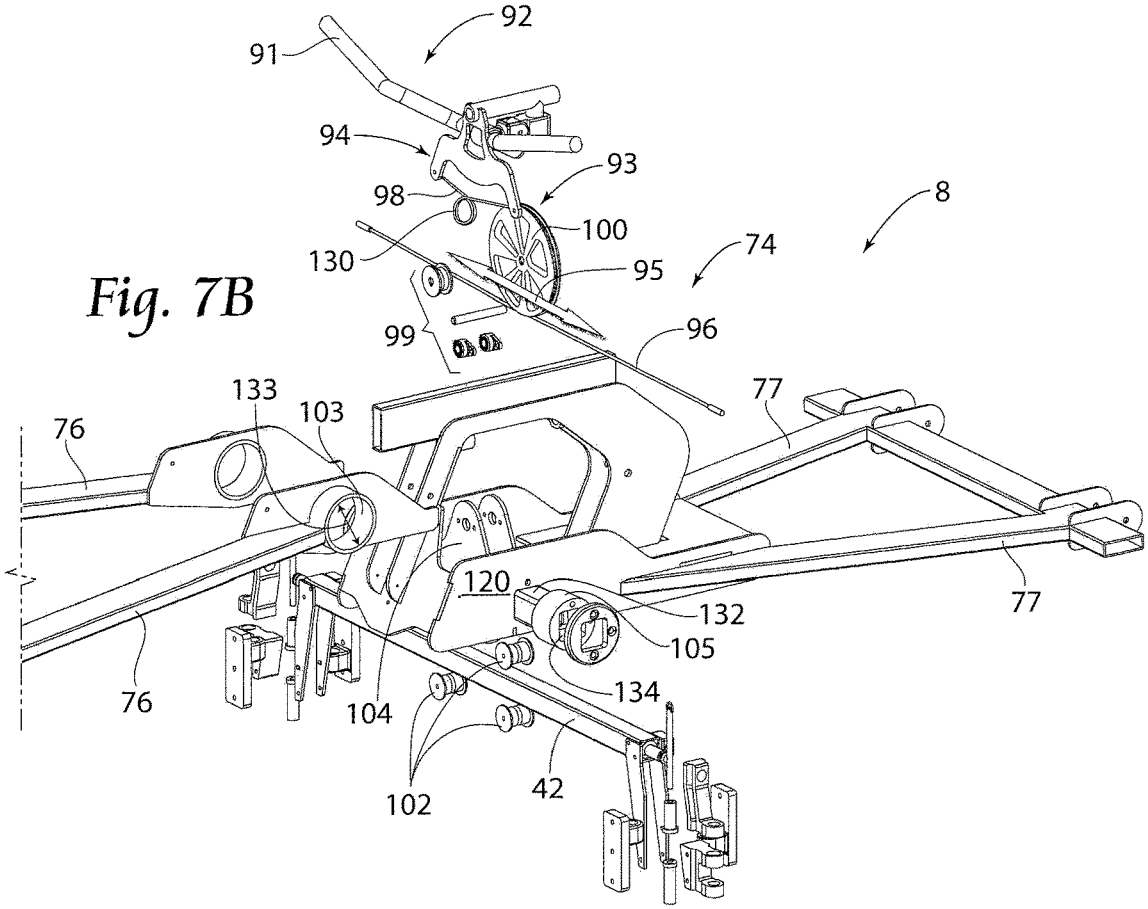
FIG. 7B is an exploded view of the frame illustrating the steering assembly.
Figure 7C:
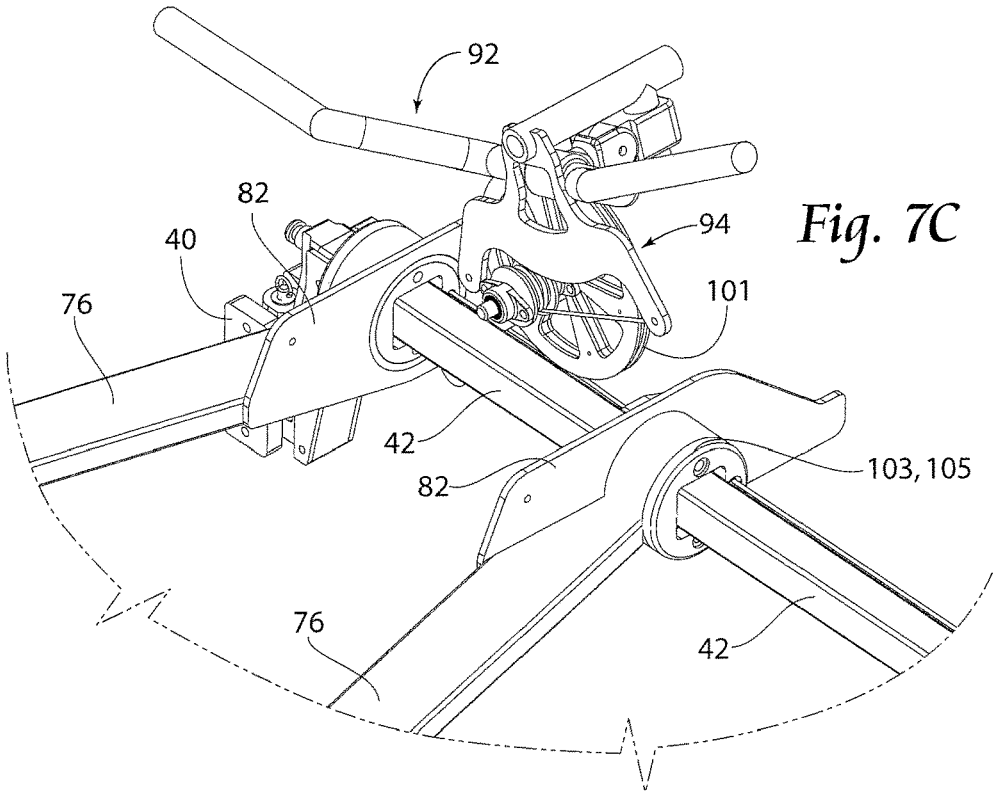
FIG. 7C is a close-up of handle assembly in communication with a center rack wire.

With attention to FIGS. 7A, 7B and 7C, a steering assembly 92 is illustrated in relationship to the folding collapsible frame 8. As illustrated in FIG. 7A, the steering assembly 92 is positioned within the central frame cavity 121. The steering assembly 92 comprises at least one of a handle assembly 94, wheel components 93, at least one roller 102, and the center rack 42. The handle assembly 94 comprises a handle bar 91 in fixed communication with a steering guide wire 98. The wheel components 93 are in rotational communication with the handle assembly 94. The wheel components 93 comprise a guide wheel 100 in rotational communication with wheel mounting components 99. Specifically, the wheel mounting components 99 are in rotational interaction with a loop 130 of the steering guide wire 98 to provide for rotation of the guide wheel 100. The wheel mounting components 99 attach the guide wheel 100 to a guide wheel bracket 104 of the folding collapsible frame 8 to provide for rotation of the guide wheel 100. Wherein the guide wheel 100 advances in a rolling direction 95 at least substantially parallel to the center rack 42. As illustrated in FIGS. 7A and 7C, a center rack wire 96 is in fixed communication with the center rack 42 along the center rack length 131. Wherein the center rack wire 96 is at least substantially parallel to the center rack 42. As illustrated in FIG. 9, the center rack wire 96 is attached to at least one of the center rack first end 62 and the center rack second end 67 at a wire mount 97 to provide for the substantially parallel orientation between the center rack wire 96 and the center rack 42. Wherein a wheel circumference 101 contacts and rolls along the center rack wire 96 when an operator (not illustrated in the figures) rotates the handle bar 91. As illustrated in FIG. 7B, the at least one rollers 102 contact the center rack 42 to provide stability of the center rack 42. It is observed the steering assembly 92, specifically the guide wheel 100 in rotational communication with wheel mounting components 99, comprises a multi-radius wheel assembly which is in rotational communication with the center rack 42, in order to adjust the center rack 42. As a result the steering assembly 92, specifically the guide wheel 100 in rotational communication with wheel mounting components 99, acts as a magnifier of the steering into placed upon the handle assembly 94 by an operator. For example, a 3-4 inch movement of the handle bar 91 may equate to a 10 11 inch movement of the center rack 42.

With further attention to FIGS. 7B and 7C, rotation interaction of the at least one first arm 76 with the center rack 42 is illustrated. The first arm central frame end 82 provides for a first arm through hole 103. At least one center rack bearing 105 is provided about a center rack outer perimeter 132 in fixed communication with the center rack 42. A first arm through hole inner diameter 133 is at least substantially equal to a center rack bearing outer diameter 134 to provide for rotation of the at least one first arm 76, and the folding collapsible frame 8, and the watercraft 2, between the extended operational configuration 12 and the folded configuration 58.

Figure 8A:
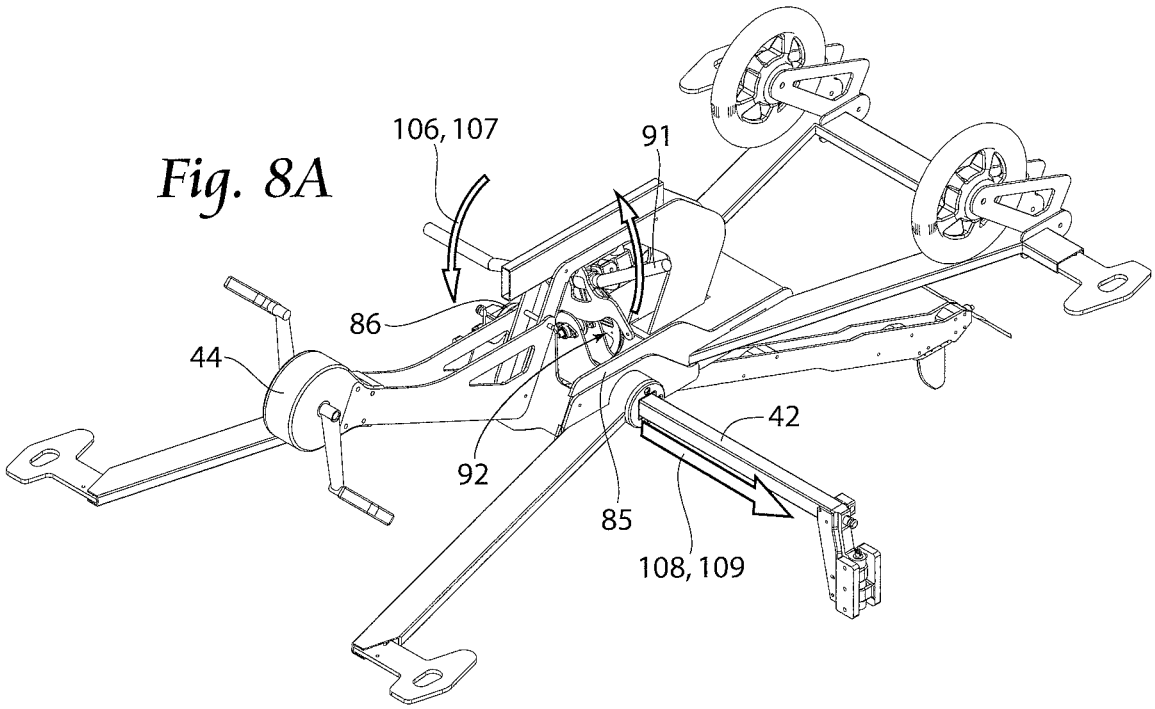
FIG. 8A is a perspective top plan view of the invention illustrating an interrelationship between a position of a handle bar and a position of the center rack.
Figure 8B:
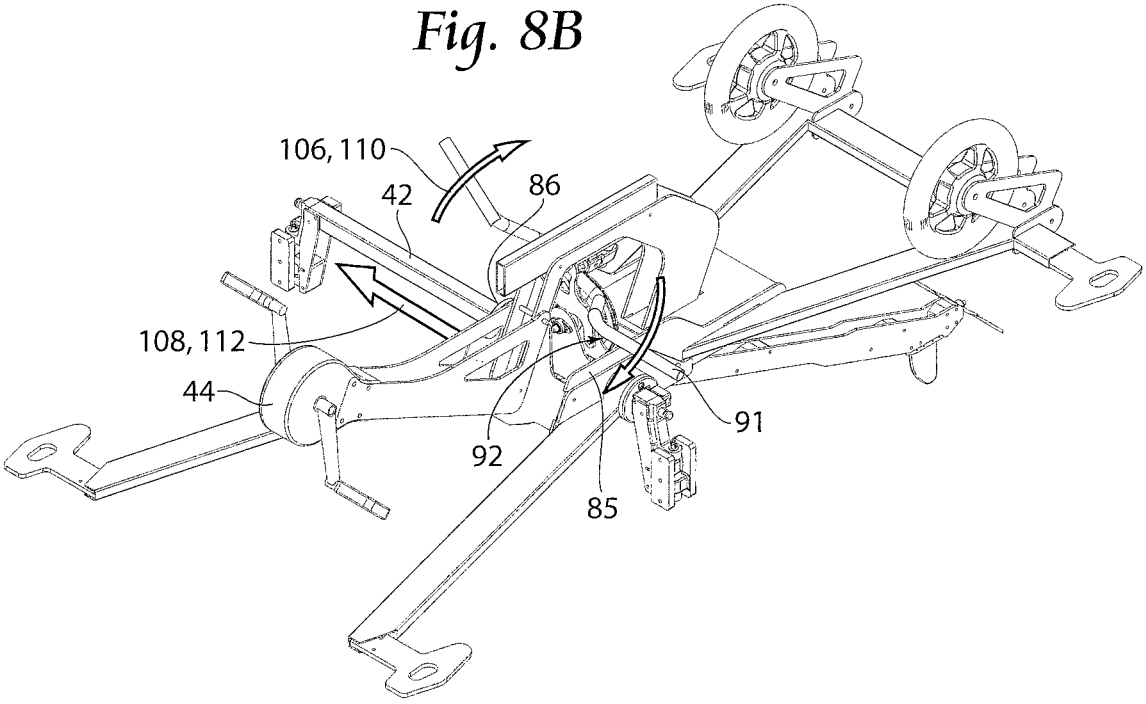
FIG. 8B is a perspective top plan view of the invention illustrating the interrelationship between the position of the handle bar and a position of the center rack.

With attention to FIGS. 8A and 8B, an interrelationship between positioning of the handle bar 91 and the center rack 42 is illustrated. As illustrated in FIG. 8A, where the handle bar 91 is positioned such that the handle bar 91 advances 106 in a counter clock-wise rotation 107, with respect to an operator (not illustrated in the figures) positioned facing the pedal assembly 44, the steering assembly rotates such that the center rack 42 travels 108 in a first side direction 109 beyond the central first side 85. As illustrated in FIG. 8B, where the handle bar 91 is positioned such that the handle bar 91 advances 106 in a clock-wise rotation 110, with respect to an operator (not illustrated in the figures) positioned facing the pedal assembly 44, the steering assembly rotates such that the center rack 42 travels 108 in a second side direction 112 beyond the central frame second side 86.

With attention to FIGS. 9 and 10, the hull pivot joint 40 is further illustrated. As illustrated in FIG. 9, the hull pivot joint 40 is removably attached to the center rack first end 62. A second hull pivot joint 40 is removably attached to the center rack second end 67. As illustrated in FIG. 10, an axle 111 extends from at least one of the center rack first end 62 and the center rack second end 67 along a center rack longitudinal axis 135. The axle 111 having an axle annular grove 136. A spring 137 releasably is in slidable communication about the axle circumference 141. A two piece collar 138 is positioned in the axle annular groove 136 to provide for a barrier for the spring 137 to compress. The two piece collar 138 may be substituted with at least one of an O-ring, or a bolt and washer combination to provide the barrier for the spring 137. Alternatively, the two piece collar 138 may be substituted with at least one of an O-ring, and a bolt and washer combination to provide the barrier for the spring 137. A center pivot joint component 139 having a center through hole 142 provides for the axle 111 to be in slidable communication with the center through hole 142. Wherein the center pivot joint component 139 abuts at least one of the center rack first end 62 and the center rack second end 67 such that the center pivot joint component 139 is position between at least one of the center rack first end 62 and the center rack second end 67, and the spring 137. When the watercraft 2 is adjusted between the extended operational configuration 12 and the folded configuration 58 the center pivot joint component 139 is manually positioned to compress the spring 137. Upon rotation into the alternate configuration (12, 58) the spring 137 returns the center pivot joint component 139 to a position abutting at least one of the center rack first end 62 and the center rack second end 67. A center pivot joint spacer 140 is provided in the hull pivot joint 40. At least one of the front hull pivot joint component 64, the rear hull pivot joint component 65, the center pivot joint component 139, and the center pivot joint spacer 140 comprises an extension loop 144. Wherein at least one extension loop 144 provides for an extension loop through hole 146.

As illustrated in FIGS. 9 and 10, the extension loops 144 of the center pivot joint spacer 140 and the rear hull pivot joint component 65 are in layered communication, and releasably conjoined via a first bearing 147, to provide for a rear pivot combination 151. The center pivot joint spacer 140 is fixed to with respect to the center rack 42 thru a spacer mount 149, wherein in the center pivot joint spacer 140 and rear hull pivot joint component 65 are in fixed orientation in both the extended operational configuration 12 and the folded configuration 58. The extension loops 144 of the center pivot joint component 139 and the front hull pivot joint component 64 are in layered communication, and in releasably conjoined via a second bearing 148, to provide for a front pivot combination 152.

Figure 11A:
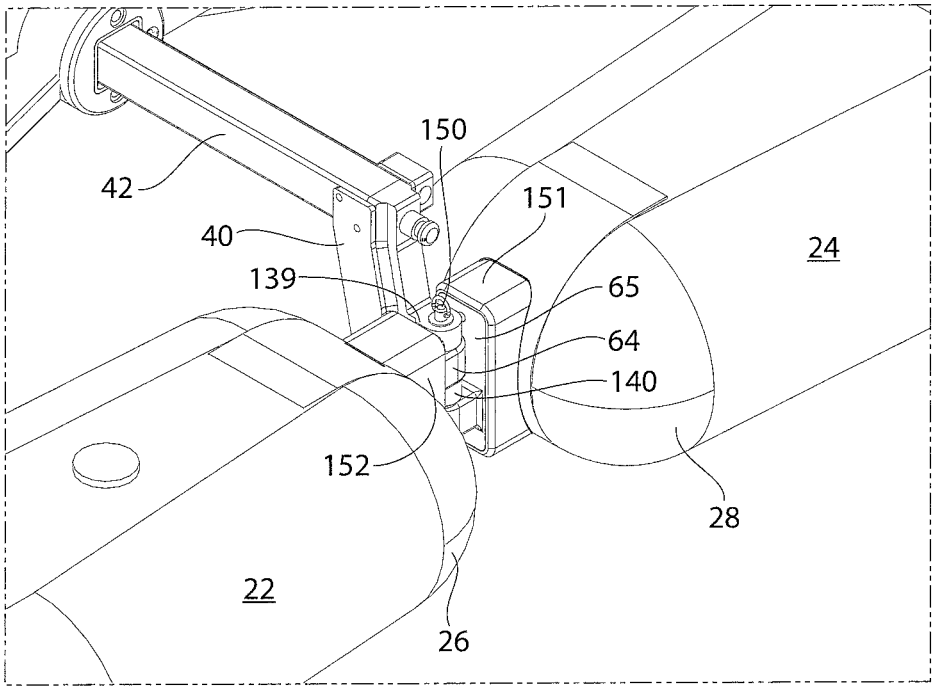
FIG. 11A is a close-up of the at least one hull pivot joint in communication with at least one hull.
Figure 11B:
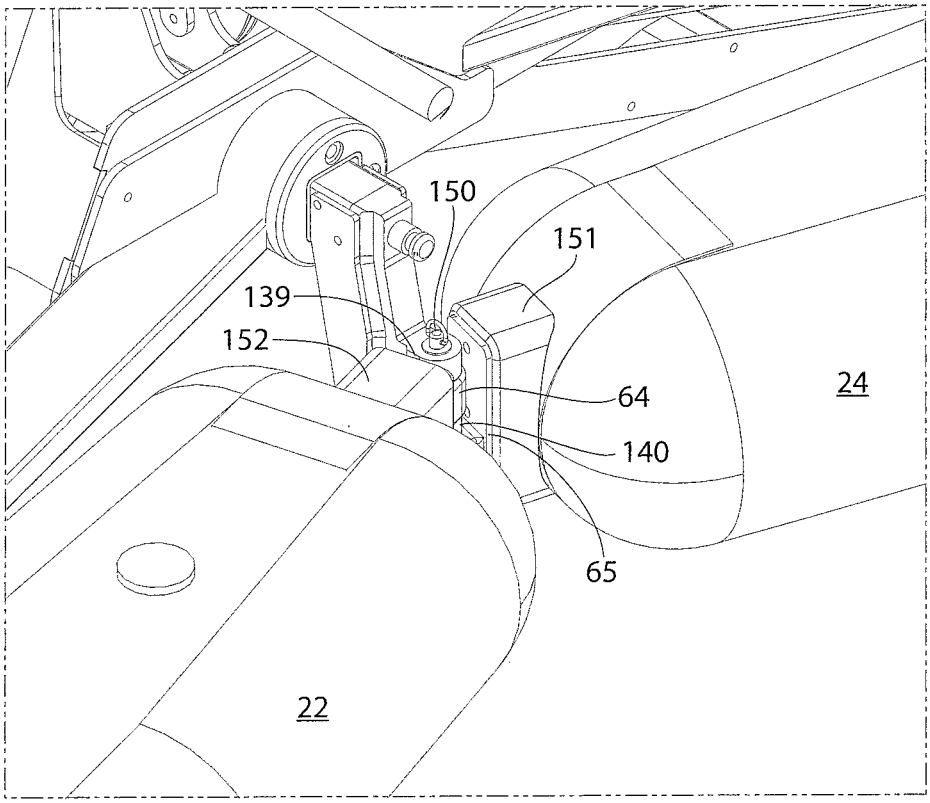
FIG. 11B is a close-up of the at least one hull pivot joint in communication with at least one hull, illustrating the at least one hull in an articulated position.

With attention to FIGS. 11A and 11B, the interrelationship of the hull pivot joint 40 and the hulls (22, 24) is illustrated. As illustrated in FIG. 11A, the rear hull 24 is in fixed communication with at least one of the center pivot joint spacer 140 and rear hull pivot joint component 65 in the rear pivot combination 151. The front hull 22 is in fixed communication with at least one of the center pivot joint component 139 and front hull pivot joint component 64 in the front pivot combination 152. As illustrated in FIG. 11B, the positioning of the center rack 42 provides for articulation of the center pivot joint spacer 140 and rear hull pivot joint component 65, and thus the rear hull 24, and the positioning of the center rack 42 provides for articulation of the center pivot joint component 139 and the front hull pivot joint 64, and thus the front hull 22.

As illustrated FIGS. 10, 11A and 11B, in the extended operational configuration 12, the rear pivot combination 151 and the front pivot combination 152 are removably oriented in layered combination with respect to one another such that the extension loop through hole 146 of at least one of the center pivot joint spacer 140, rear hull pivot joint component 65, the center pivot joint component 139 and front hull pivot joint component 64 are in at least substantial alignment. Further a first bearing through bore 204 of the first bearing 147 and a second bearing through bore 205 of the second bearing 148 are in substantial alignment. Wherein, a second locking pin 150 may be inserted into the extension loop through hole 146 of at least one of the center pivot joint spacer 140, rear hull pivot joint component 65, the center pivot joint component 139 and front hull pivot joint component 64 are in at least substantial alignment to provide for locking of the watercraft 2 in the extended operational configuration 12. Specifically, the second locking pin 150 may be inserted into the first bearing through bore 204 of the first bearing 147 and the second bearing through bore 205 of the second bearing 148, which are in substantial alignment, to provide for locking of the watercraft 2 in the extended operational configuration 12.

Figure 12A:
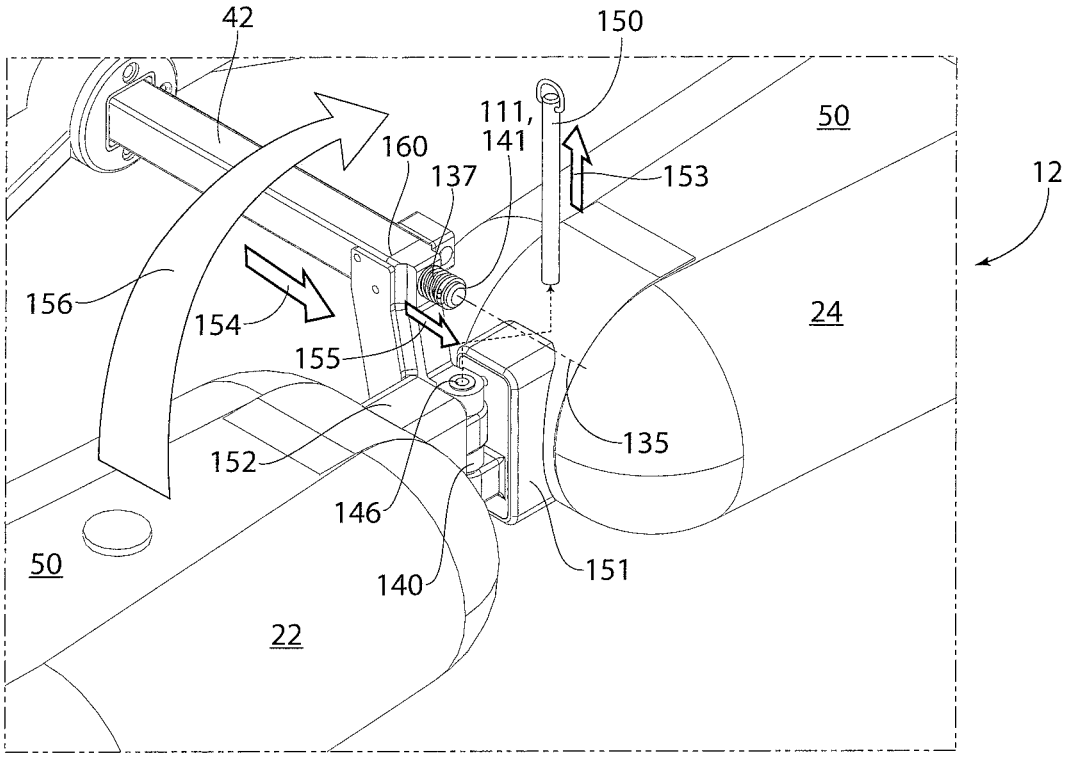
FIG. 12A is a method of folding the invention.
Figure 12B:
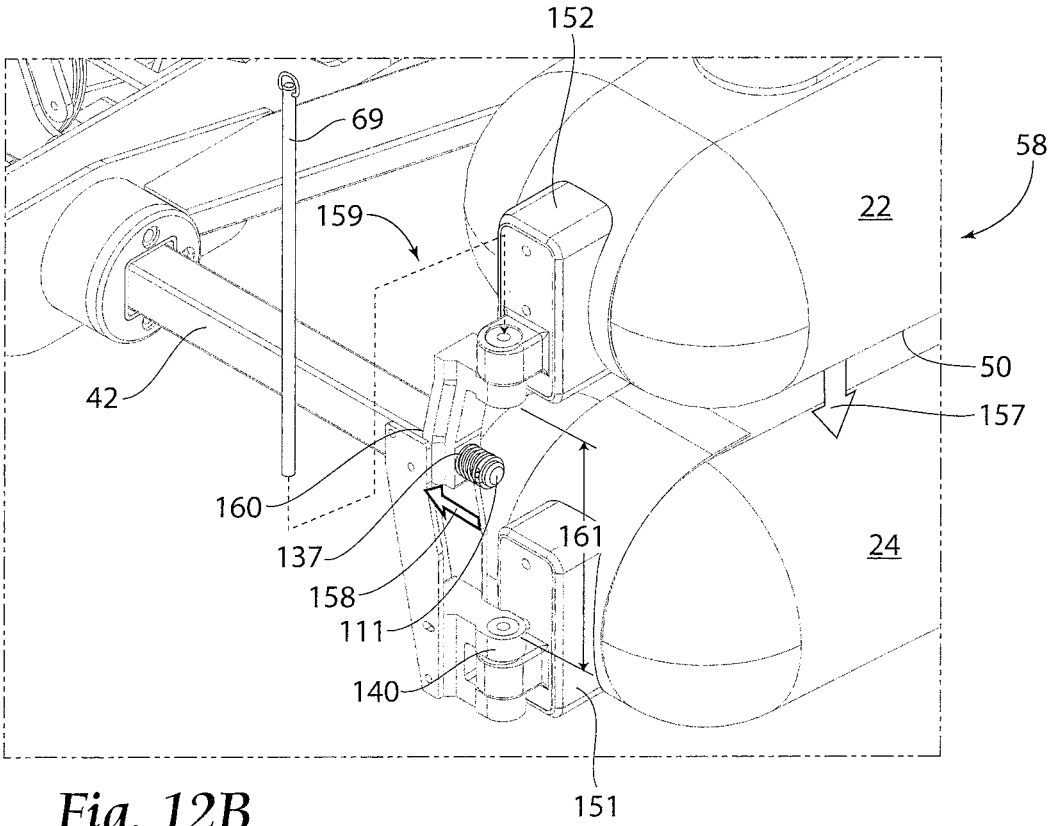
FIG. 12B is a method for securing the folded hulls for transport and storage.
Figure 13:
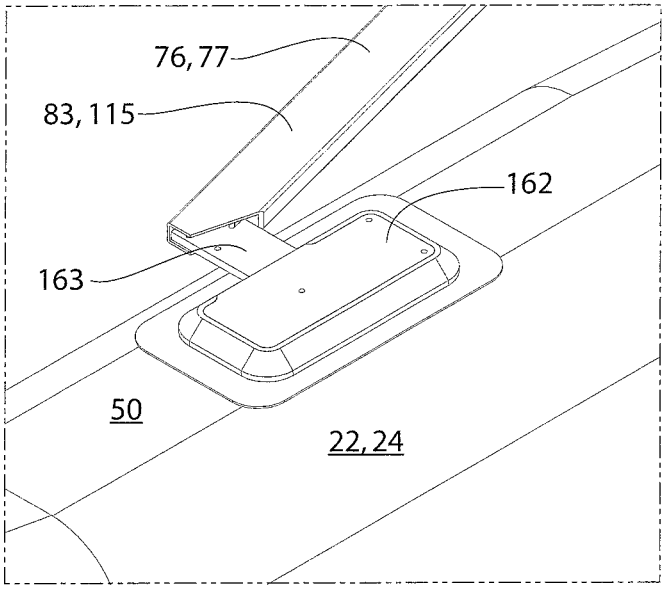
FIG. 13 is a close-up of at least one pivot pad of the invention in communication with the at least one hull of the invention.

With respect to FIGS. 12A and 12B, a method of transforming the watercraft 2 from the extended operational configuration 12 to the folded configuration 58 is illustrated. As illustrated in FIG. 12A, The second locking pin 150 is slidably removed from the extension loop through hole 146 of at least one of the center pivot joint spacer 140, rear hull pivot joint component 65, the center pivot joint component 139 and front hull pivot joint component 64, which are in at least substantial alignment to provide for locking of the watercraft 2 in the extended operational configuration 12, 150. Advancing the front pivot combination 152 over the axle circumference 141 and along the center rack longitudinal axis 135, removing the front pivot combination 152 and front hull 22 from a locked hull position 16, 154. Compressing the spring 137 during the advancement of the front pivot combination 152 over the axle circumference 141, 155. As illustrated in FIGS. 12A and 12B, rotation of the front pivot combination 152 and the front hull 22 about the axle 11 and the center rack, 156. Positioning the front pivot combination 152 and the front hull 22 in the folded configuration 58, such that the watercraft first side 50 of the front hull 22 is in substantially close proximity to the watercraft first side 50 of the rear hull 24, 157. Providing for the spring 137 to return the front pivot hull combination 152 and the front hull 22 to a locked hull position 160, 158. Inserting the first locking pin 69 through the through hole 146 of at least one of the center pivot joint spacer 140, rear hull pivot joint component 65, the center pivot joint component 139 and front hull pivot joint component 64, which are in at least substantial alignment to provide for locking of the watercraft 2 in the locked configuration 58, the front pivot hull combination 152 and the rear pivot hull combination 151 are separated by a locking configuration distance 161 that the first locking pin 69 traverses, 159. It is observed the method of folding as illustrated in FIGS. 12A and 12B is reversed to convert the watercraft 2 from the folded configuration 58 to the extended operational configuration 12.

With respect to FIGS. 13, 14, 15A and 15B, an at least one pivot pad 162 is illustrated. A pivot pad 162 is positioned on the watercraft first side 50 of at least one of the front hulls 22 and the rear hulls 24. The pivot pad 162 is in slidable connection with a pivot arm 163, extending from the pivot pad 162 and in the direction of at least one of the first arm pad end 83 and the second arm pad end 115. The respective pivot arm 163 and the respective at least one of the first arm pad end 83 and the second arm pad end 115, in close proximity to the respective pivot arm 163, are in slidable communication to provide for articulation of the respective hull (22, 24) for which the respective pivot arm 163 is in slidable communication.

Figure 14:
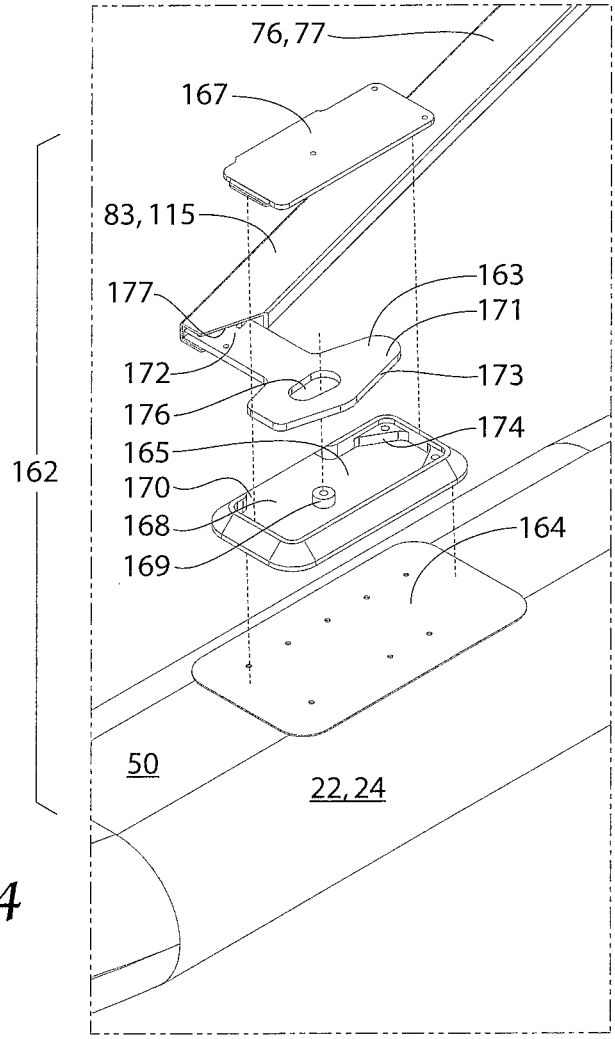
FIG. 14 is an exploded view of the at least one pivot pad of the invention in communication with the at least one hull of the invention.

As illustrated in FIG. 14, the pivot pad 162 comprises a pad base 164, pad cradle 165 and a pad cover 167. The pad base 164 is in fixed to the watercraft first side 50 of the respective hull (22, 24). The pad cradle 165 is removable fixed to the pad base 164, wherein the pad base 164 provides for retaining the pad cradle 165 in position. Opposite the pad base 164 the pad cradle 165 comprises a cradle cavity 168, wherein the cradle cavity 168 has a cavity opening 170. The cradle base 165 provides for a cradle extension 169 extending at least one of opposite the cradle base 164 and into the cradle cavity 168. The cradle cover 167 is removably fixed on the pad cradle 165 and covers the cavity opening 170, wherein the cradle cover 167 provides a barrier between the outside environment and the cradle cavity 165.

The pivot arm 163 has an arm first end 171 and an arm second end 172. The arm first end 171 has a first end dimension 173 which compliments a cradle cavity dimension 174. The arm first end 171 having a first end through hole 176 such that the arm first end 171 slidably rests inside the cradle cavity 168, wherein the cradle extension 169 extends at least one of into the first end through hole 176 and through the first end through hole 176.

The arm second end 172 is in slidable communication with an arm opening 177 of the respective at least one of the first arm pad end 83 and the second arm pad end 115, in close proximity to the respective arm second end 172, to provide for articulation of the respective hull (22, 24) for which the respective pivot arm 163, associated with the respective arm second end 172, is in slidable communication.

Figure 15A:
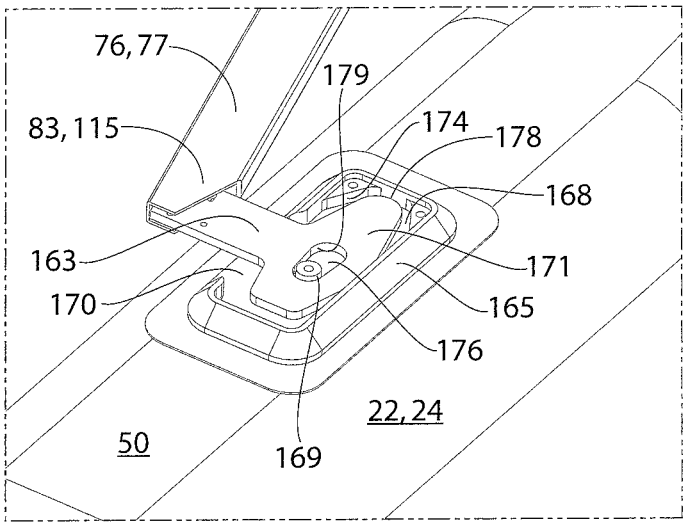
FIG. 15A is a close-up of the at least one pivot pad illustrating positioning of a first arm pad end within a pad cavity.
Figure 15B:
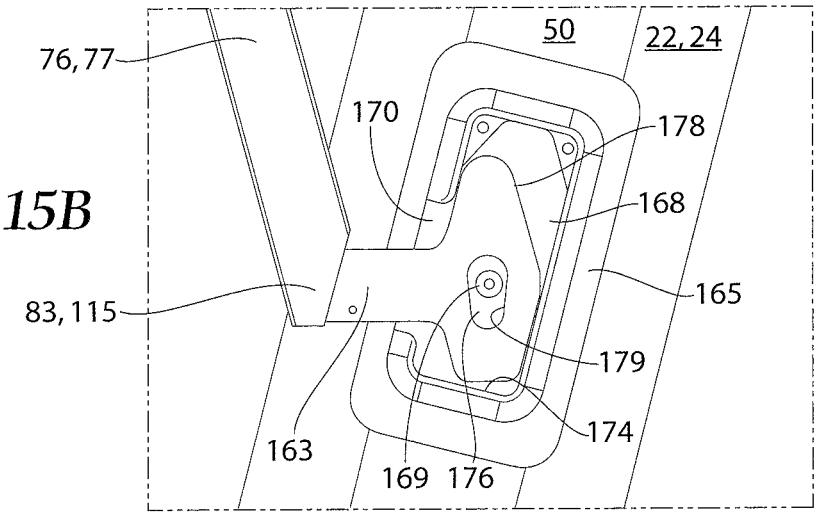
FIG. 15B is a close-up of the at least one pivot pad illustrating positioning of the first arm pad end within the pad cavity.

As illustrated in FIGS. 15A and 15B, the positioning of the arm first end 171 within the pad cavity 168 is further illustrated. As illustrated in FIG. 15A, the hull (22, 24) is in a non-articulated position. The cradle extension 169 retains the pivot arm first end 171 within the cradle cavity opening 170 and the cradle cavity 168, wherein a through hole wall 179 of the first end through hole 176 retains the cradle extension 169. The force to promote a non-articulated position of the hulls (22, 24) is provided by the releasable contact between the cradle cavity dimension 174 and the first end dimension 173 of the arm first end 171. Specifically, the contact between at least one first end surface 178 of the first end dimension 173 and the cradle cavity dimension 174 provides for the force to maintain the hulls (22, 24) in a non-articulated orientation. As illustrated in FIG. 15B, the hull (22, 24) is in an articulated position, the articulation may be to at least one of the first side 14 and the second side 16 of the watercraft 2. The cradle extension 169 retains the pivot arm first end 171 within the cradle cavity opening 170 and the cradle cavity 168, wherein a through hole wall 179 of the first end through hole 176 retains the cradle extension 169. The force to promote an articulated position of the hulls (22, 24) is provided by the releasable contact between the cradle cavity dimension 174 and the first end dimension 173 of the arm first end 171. Specifically, the contact between at least one first end surface 178 of the first end dimension 173 and the cradle cavity dimension 174 provides for the force promote the hulls (22, 24) in an articulated orientation. Further, the slidable relationship between the pivot arm 163 and pivot pad 162 provides for maneuverability of the hull (22, 24) into an articulated position. An intended benefit of the invention is to provide for a slidable relation between the folding collapsible frame 8 and the hull (22, 24) to provide for maximized articulation.

Figure 16A:
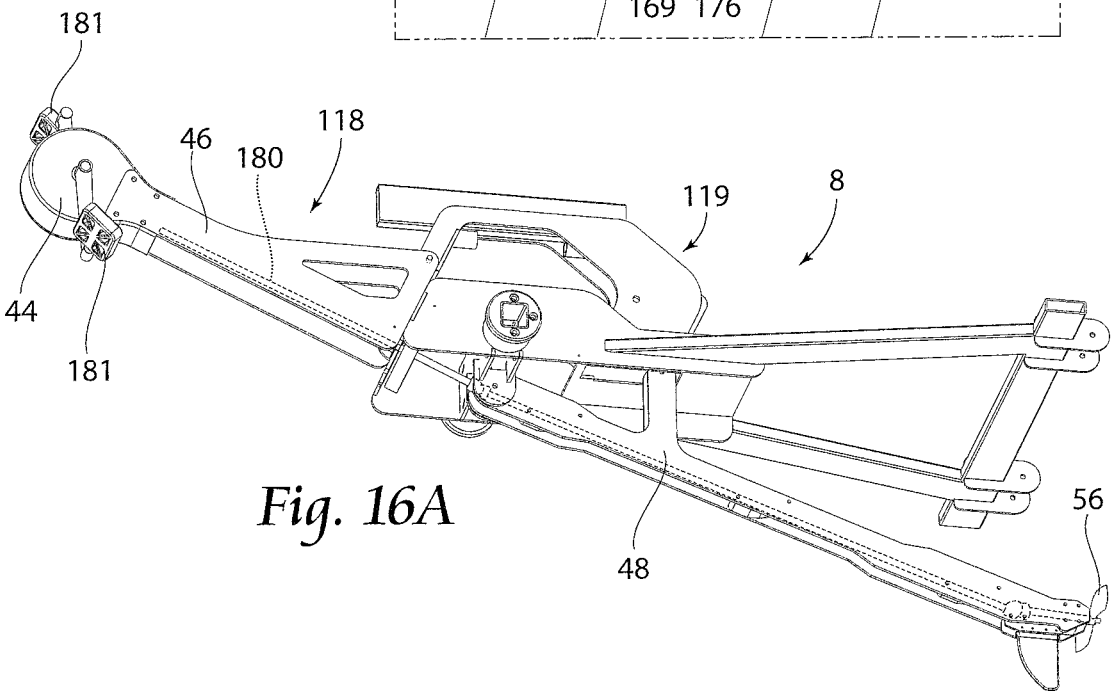
FIG. 16A is a perspective bottom plan view of the frame of the invention illustrating a drive assembly.
Figure 16B:
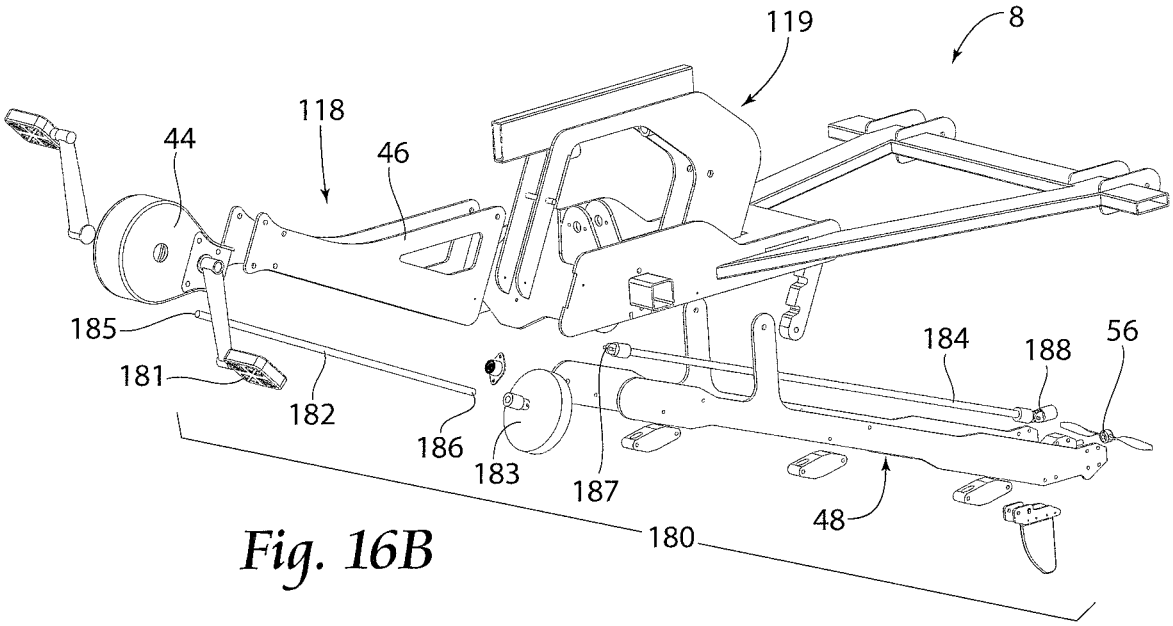
FIG. 16B is an exploded view of a drive assembly of the invention illustrating the drive assembly.

With attention to FIGS. 16A and 16B, a drive assembly 180 of the watercraft 2. As illustrated in FIG. 16A, the drive assembly 180 extends from the pedal assembly 44, through the forward frame 118 and to the central frame 119, through the central frame 119 and to the lower drive assembly 48, and through the lower drive shaft assembly 48 to the propeller 56. Wherein the drive assembly 180 provides propulsion to advance the watercraft 2 through operator (not illustrated in the figures) manipulation of the pedals 181 of the pedal assembly 44. Wherein the rotational manipulation of the pedals 181 is transferred through the drive assembly 180 and results in rotation of the propeller 56. As illustrated in FIG. 16B, the drive assembly 180 comprises at least one of the pedals 181, an upper drive shaft 182, a fly wheel 183, a lower drive shaft 184 and the propeller 56 in rotational communication with one another. Wherein the pedals 181 are in rotational communication with an upper drive shaft first end 185. An upper drive shaft second end 186 is in at least one of removable and rotational communication with the fly wheel 183. The removable communication of the upper drive shaft second end 186 with the fly wheel 183 provides for the rotational pivoting of the forward frame 118 when the watercraft 2 is placed in the folded configuration, reference FIG. 6B. A lower drive shaft first end 187 is in communication with the fly wheel 183 to further transfer the rotational force provided by the pedals 181. A lower drive shaft second end 188 is in rotation communication with the propeller 56, wherein the propeller 56 is rotated to advance the watercraft 2. It is observed, the watercraft 2 may provide for mechanized modes of propulsion for example: gearing systems and motorized systems. An intended benefit of the present invention is to provide for a watercraft 8 having a drive assembly 180 able to be folded with ease for storage, folded configuration 58, and operation, extended operational configuration 12. It is observed the flywheel 183 is a tunable flywheel having adjustable weights (not illustrated in the figure). The adjustable weights of the flywheel 183 allows for low inertial start-up and a release at an increased or higher operation speed of the watercraft 2.

Figure 17A:
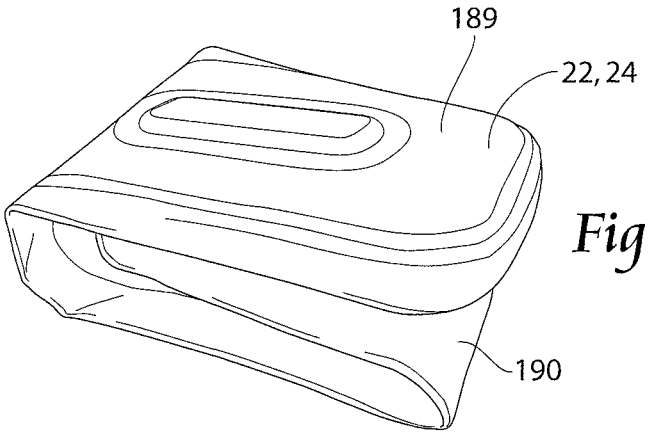
FIG. 17A is a perspective view of the at least one hull in a deflated hull position.
Figure 17B:
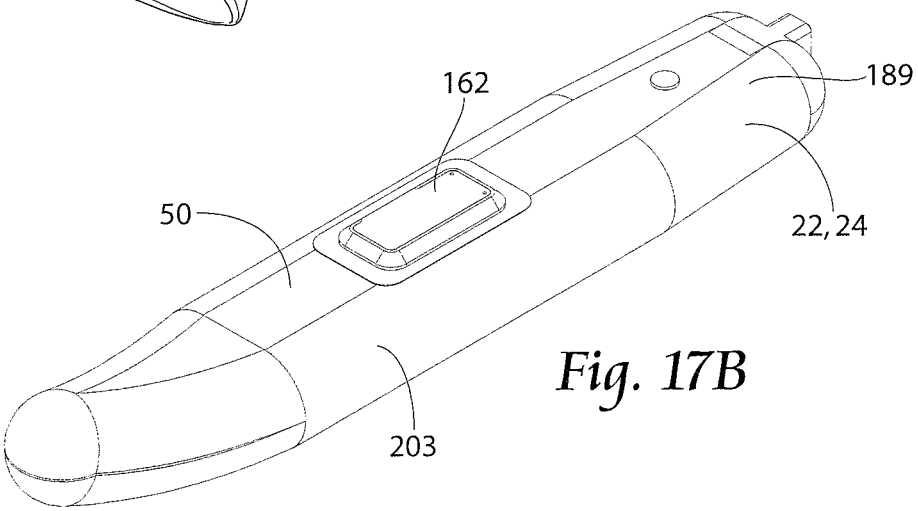
FIG. 17B is a perspective view of the at least one hull in an inflated hull position.

With respect to FIGS. 17A and 17B, the hull (22, 24) is further illustrated. The hull (22, 24) may be in an inflated hull position 203, reference FIG. 17B. The hull (22, 24) may be a drop stitch hull 189 to promote a flat surface upon which a pivot pad 162 may be positioned, reference FIG. 17B. FIG. 17A illustrates the hull (22, 24) may be arranged into deflated hull position 190 for storage.

Figure 18A:
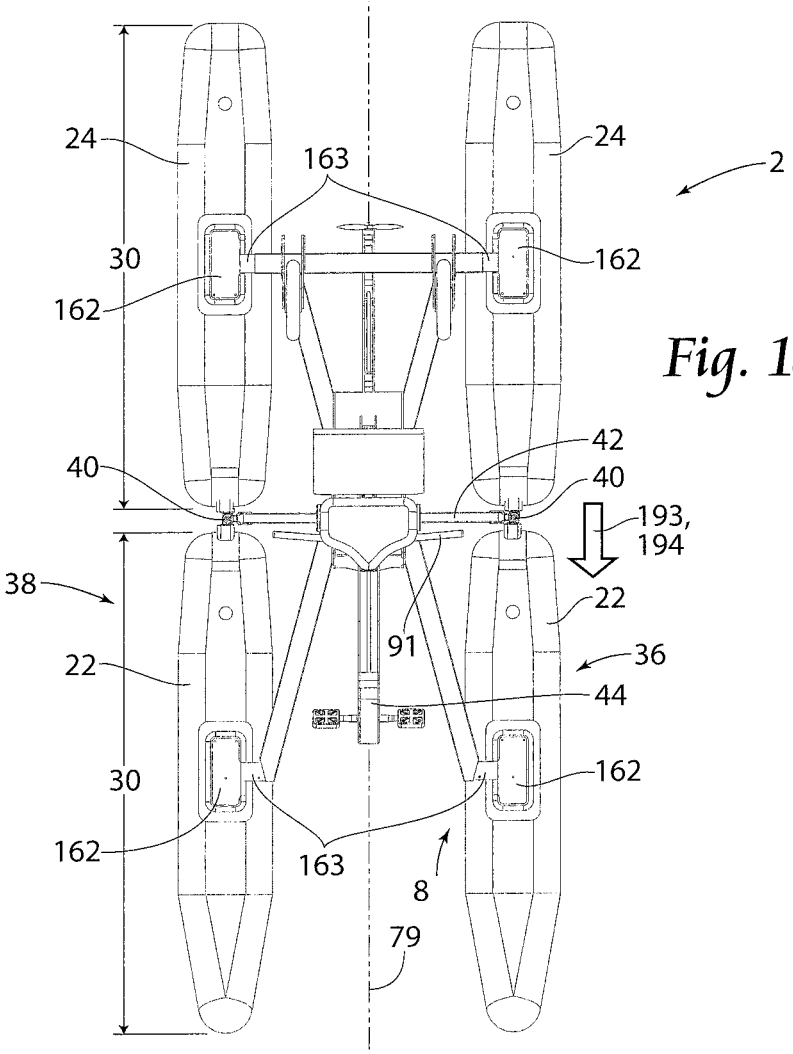
FIG. 18A is a method of operating the invention illustrating the at least one hull in a non-articulated state.
Figure 18B:
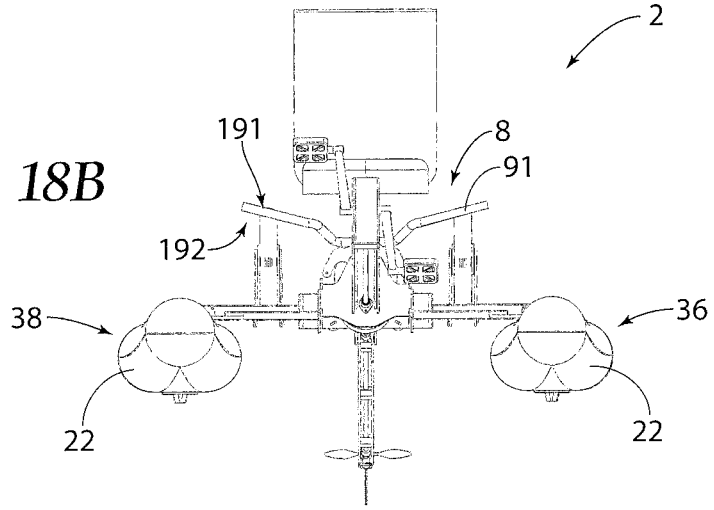
FIG. 18B is the method of operating the invention illustrating the at least one hulls in a non-articulated state.
Figure 19A:
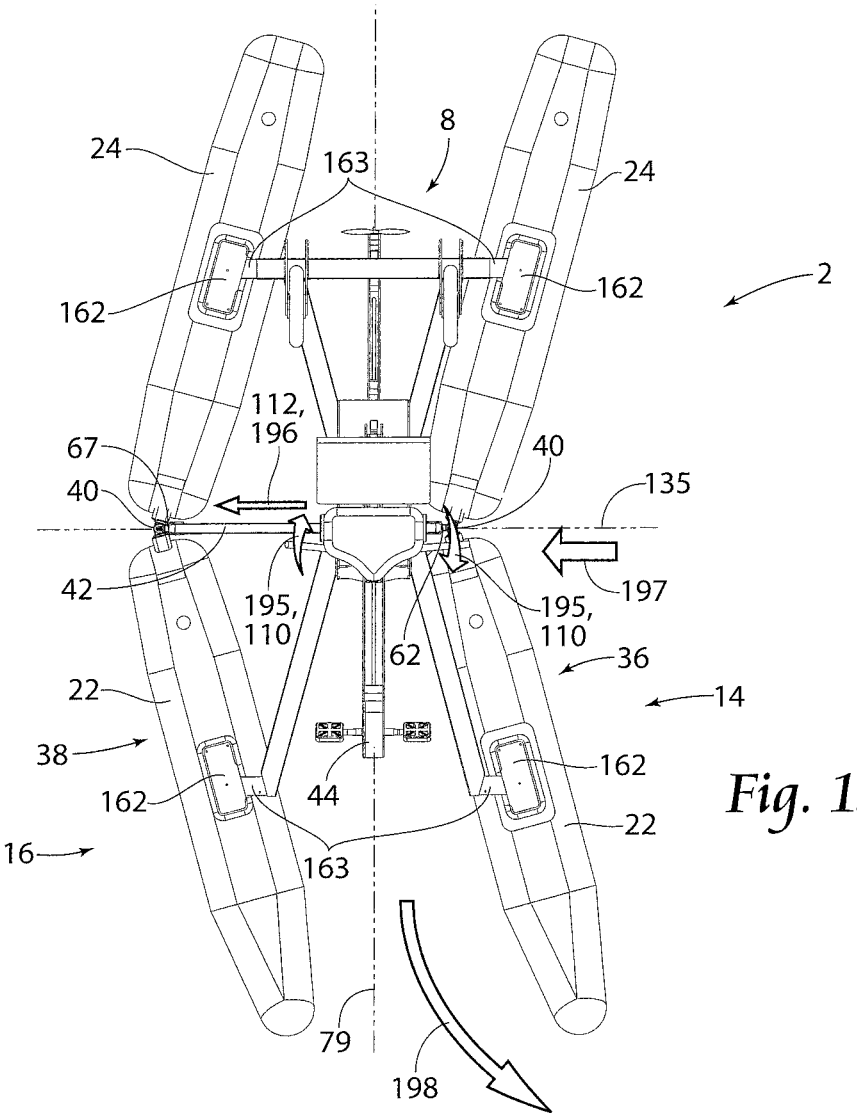
FIG. 19A is the method of operating the invention illustrating articulation of the invention towards a first side.
Figure 19B:
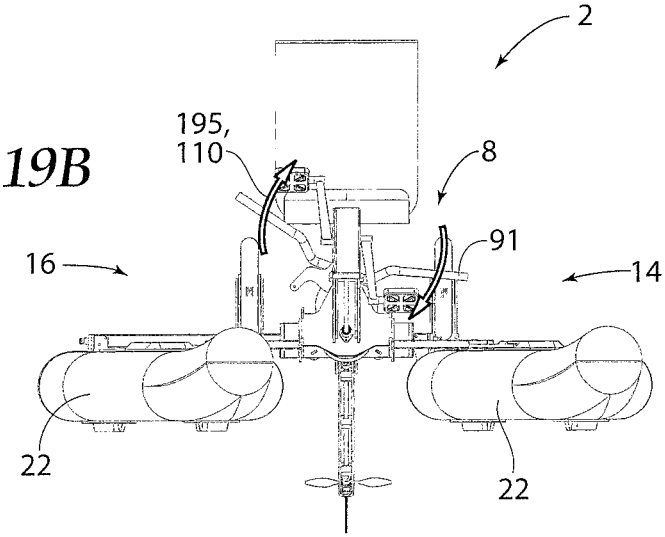
FIG. 19B is the method of operating the invention illustrating articulation of the invention towards the first side.
Figure 20A:
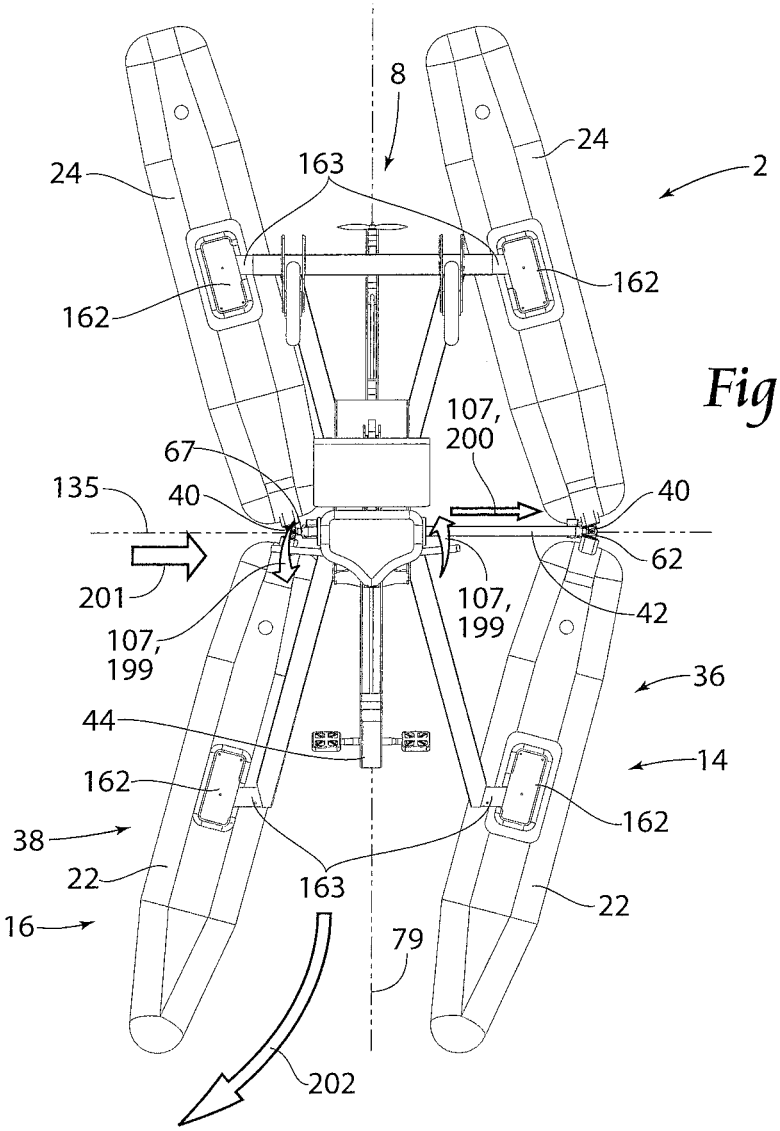
FIG. 20A is the method of operating the invention illustrating articulation of the invention towards a second side.
Figure 20B:
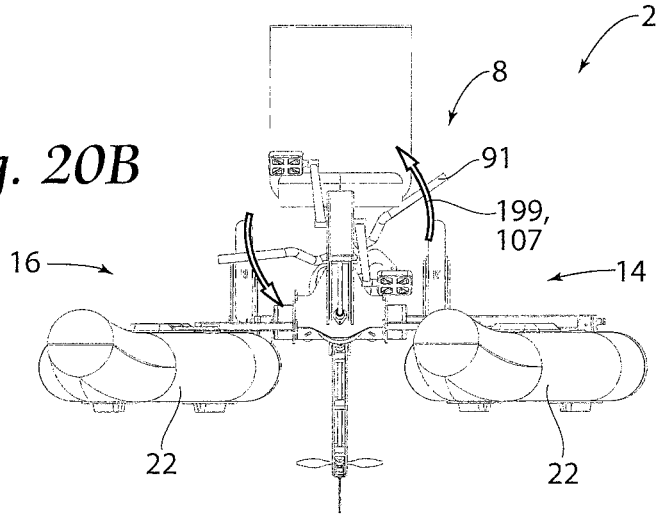
FIG. 20B is the method of operating the invention illustrating articulation of the invention towards the second side.

FIGS. 18A, 18B, 19A, 19B, 20A and 20B illustrate a method for operation of the watercraft 2. As illustrated in FIGS. 18A and 18B, positioning the handle bar 91 in a forward position 192 such that the hull length 30 of each of the respective hulls (22, 24) of the first hull set 36 and second hull set 38 are at least substantially parallel to the longitudinal axis 79, 191. Traveling in a non-articulated direction 193, 194. As illustrated in FIGS. 19A and 19B, advancing the handle bar 91 is positioned such that the handle bar 91 in a clock-wise rotation 110, with respect to an operator (not illustrated in the figures) positioned facing the pedal assembly 44, 195. Advancing the center rack 42 in a second side direction 112, 196. Wherein the hulls (22, 24) of the first hull set 36 are joined at the hull pivot joint 40 in communication with the center rack first end 62, and the hulls (22, 24) of the second hull set 38 are joined at the hull pivot joint 40 in communication with the center rack second end 67, such that the hulls (22, 24) of the first set 36 and the hulls of the second set 38 commonly pivot towards the second side 16, 197. The watercraft 2 turns towards the first side 14, 198. As illustrated in FIGS. 20A and 20B, advancing the handle bar 91 is positioned such that the handle bar 91 in a counter clock-wise rotation 107, with respect to an operator (not illustrated in the figures) positioned facing the pedal assembly 44, 199. Advancing the center rack 42 in a first side direction 109, 200. Wherein the hulls (22, 24) of the first hull set 36 are joined at the hull pivot joint 40 in communication with the center rack first end 62, and the hulls (22, 24) of the second hull set 38 are joined at the hull pivot joint 40 in communication with the center rack second end 67, such that the hulls (22, 24) of the first set 36 and the hulls of the second set 38 commonly pivot towards the first side 14, 201. The watercraft 2 turns towards the second side 16, 202.

Figure 21A:
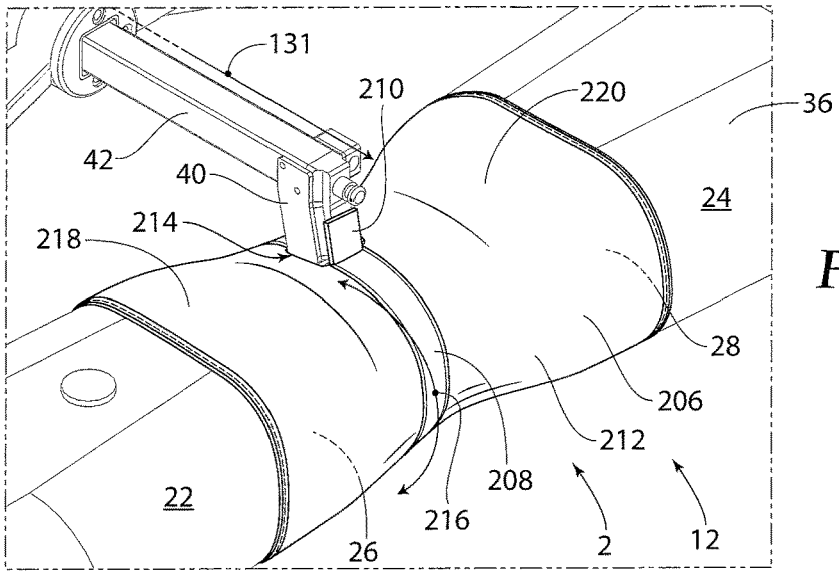
FIG. 21A is a perspective view of a first hull set illustrating a first embodiment of a skirt connecting a first hull and a second hull.
Figure 21B:
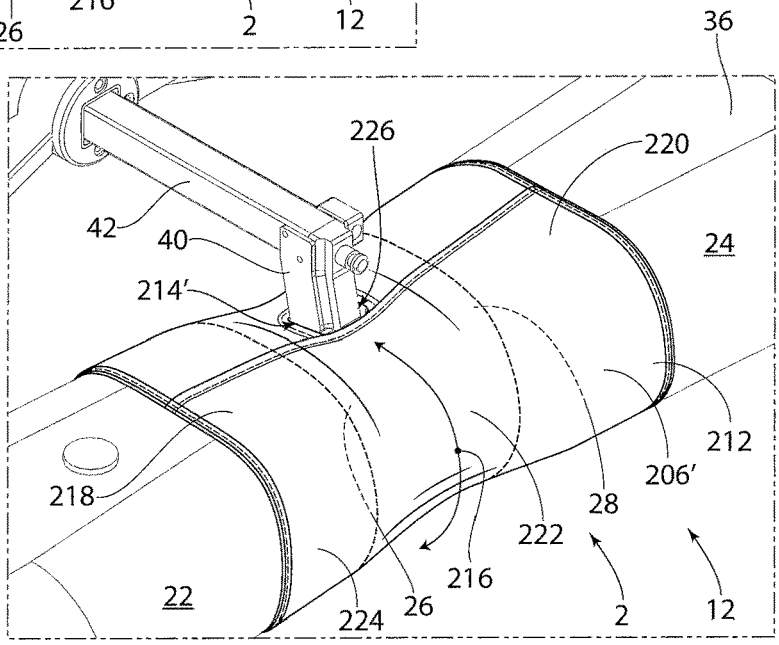
FIG. 21B is a perspective view of said first hull set illustrating a second embodiment of a skirt connecting said first hull and said second hull.
Figure 21C:
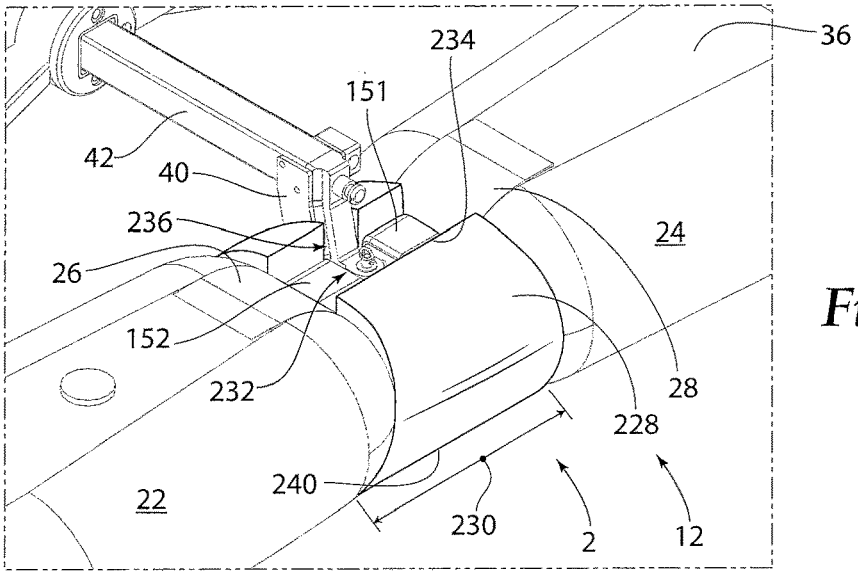
FIG. 21C is a perspective view of said first hull set illustrating an insert positioned between said first hull and said second hull.

FIGS. 21A, 21B and 21C address a fluid dynamics concern where the first hull 22 and the second hull 24 are close to one another but separate when the watercraft 2 is in the extended operational configuration 12. As illustrated FIG. 21A a first embodiment of a skirt 206 is employed to address the issue. The skirt 206 is preferably made of at least substantially neoprene, and has a tubular shape 212. A first end 218 of the skirt 206 extends over and engulfs the second end 26 of the first hull 22. A second end 220 of the skirt 206 extends over and engulfs the first end 28 of the second hull 24. The skirt 206 has a first embodiment of an opening 214 in which the pivot joint 40 extends through and is connected to the center rack 42. A stability loop 208 extends about a circumference 216 of the skirt 206, isolinear with respect to the center rack length 131. The loop 208 contacts the pivot joint 40 to at least substantially close the circumference 216 about the skirt 206. The loop 208 is comprised of a polymer, preferably a high density polymer. Wherein the loop 208 maintains the structural integrity of the skirt 206 so as to allow for increased fluid dynamic performance between the first hull 22 and the second hull 24. The skirt 206 improves the fluid dynamics of the first hull set 36 and the second hull set (not illustrated in figure) as the hull set performs as a single hull and not two hulls.

As illustrated FIG. 21B a second embodiment of a skirt 206' is employed to address the issue of fluid dynamic performance. The skirt 206' is preferably made of at least substantially neoprene, and has a tubular shape 212. A first end 218 of the skirt 206' extends over and engulfs the second end 26 of the first hull 22. A second end 220 of the skirt 206' extends over and engulfs the first end 28 of the second hull 24. The skirt 206' has a second embodiment of an opening 214' in which the pivot joint 40 extends through and is connected to the center rack 42. A plastic layer 222 extends about a circumference 216 of the skirt 206'. The layer 222 is sewn into an exterior surface 224 of the skirt 206'. Alternatively, the layer 222 is sewn into an interior surface (not illustrated in the figures) of the skirt 206'. The layer comprises a layer opening 226 complimenting the opening 214' in which the pivot joint 40 extends through and is connected to the center rack 42. The skirt 206' improves the fluid dynamics of the first hull set 36 and the second hull set (not illustrated in figure) as the hull set performs as a single hull and not two hulls.

As illustrated in FIG. 21C an insert 228 is positioned between the first hull 22 and the second hull 24. The insert 228 has a cylindrical shape having an insert length 230 which extends between the second end 26 of the first hull 22 and the first end 28 of the second hull 24 when the watercraft 2 is in the extended operational configuration 12. The insert 228 defines an insert slot 232 on the insert first side 234 which extends at least substantially the insert length 230 of the insert 228. The insert slot 232 extends into the insert 228 along the insert length 230. A second insert slot 236 is defined by the insert 228. The second insert slot 236 is at least substantially orthogonal to the insert slot 232. The insert slot 232 and second insert slot 236 allow for the insert 228 to be placed between the second end 26 of the first hull 22 and the first end 28 of the second hull 24. In doing so, at least part of the rear pivot combination 151, at least part of the front pivot combination 152, and at least part of the hull pivot joint 40 rest in at least one of the insert slot 232 and second insert slot 236. Wherein at least one of the rear pivot combination 151, the front pivot combination 152, and the hull pivot joint 40 is in slidable communication with the insert allowing for articulation or pivoting of the first hull set 36 and second hull set (not illustrated in the figure). A closed surface 240 of the insert 228 is opposite the first side 234. The insert 228 is preferably made of a closed cell foam. Alternatively, the insert maybe be made of any foam material or polymeric material. The insert 228 improves the fluid dynamics of the first hull set 36 and the second hull set (not illustrated in figure) as the hull set performs as a single hull and not two hulls.

It is observed the first embodiment of the skirt 206 may incorporate at least one feature with the second embodiment of the skirt 206', and the reverse.

It is understood the first embodiment of the opening 214 may incorporate at least one feature with the second embodiment of the opening 214', and the reverse.

It is observed the elements as described in the invention apply to both the first hull set 36 and the second hull set 38 of the watercraft 2. It is observed the methods as described apply to both the first hull set 36 and the second hull set 38 of the watercraft 2.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is disclosed in the specification.

The invention claimed is:

1. A human-powered watercraft comprising:

a first hull section and an oppositely opposed second hull section extending along a watercraft length, wherein said watercraft in an extended position;

each of said first hull section and said second hull section comprising a first hull in pivotable and removable communication with a second hull;

a frame pivotally connected to said first hull section and said second hull section;

at least one of said first hull section and said second hull section having said first hull foldable toward said second hull providing for a watercraft folded position; and at least one pivot pad in pivotal connection between said frame and at least one of said first hull and said second hull, wherein said pivot pad provides for articulation of said first hull and said second hull about said longitudinal axis.

2. The human-powered watercraft of claim 1, further comprising said first hull and said second hull in pivotal communication at a pivot joint.

3. The human-powered watercraft of claim 1, further comprising said frame having a removable seat, wherein said seat has at least two positions along said watercraft length.

4. The human-powered watercraft of claim 2, further comprising said pivot joint having a first hull component affixed to said first hull and a second hull component affixed to said second hull.

5. The human-powered watercraft of claim 4, further comprising said first hull component and said second hull component in removable interwoven communication in said extended position.

6. The human powered watercraft of claim 2, further comprising a pin in removable communication with said pivot joint for maintaining at least one of said extended position and said folded position.

7. The human-powered watercraft of claim 1, further comprising at least one retractable wheel, pivotally connected to said watercraft, having a first position when said watercraft is in said folded position.

8. The human-powered watercraft of claim 1, further comprising said frame having at least one first arm extended towards said first hull and at least one second arm extended towards said second hull.

9. The human-powered watercraft of claim 1, wherein at least one of said first hull and said second hull comprising a drop stitch hull.

10. The human-powered watercraft of claim 1, further comprising a steering assembly in communication with said frame, wherein said steering assembly articulates at least one of said first and second hull sections.

11. A human-powered watercraft comprising:

a first hull section and an oppositely opposed second hull section extending along a watercraft length;

each of said first hull section and said second hull section comprising a first hull in pivotable communication with a second hull;

a frame pivotally connected to said first hull section and said second hull section; and wherein at least one of said first hull and said second hull comprise a drop stitch hull.

12. The human-powered watercraft of claim 11, further comprising said first hull and said second hull in pivotal communication at a pivot joint.

13. The human-powered watercraft of claim 11, further comprising at least one of an insert and a skirt in communication with said first hull and said second hull, providing for an improved fluid dynamics performance.

14. The human-powered watercraft of claim 11, further comprising said frame having a removable seat, wherein said seat has at least two positions along said watercraft length.

15. The human-powered watercraft of claim 12, further comprising said pivot joint having a first hull component affixed to said first hull and a second hull component affixed to said second hull.

16. The human-powered watercraft of claim 11, further comprising said frame having at least one first arm extended towards said first hull and at least one second arm extended towards said second hull.

17. The human-powered watercraft of claim 11, further comprising at least one pivot pad in pivotal connection between said frame and at least one of said first hull and said second hull, wherein said pivot pad provides for articulation of said first hull and said second hull about said longitudinal axis.

18. The human-powered watercraft of claim 11, further comprising at least one retractable wheel, said wheel pivotally connected to said watercraft.

19. The human-powered watercraft of claim 11, further comprising a steering assembly in communication with said frame, wherein said steering assembly articulates at least one of said first and second hull sections.

* * * * *